United States Patent [19]

Edamura

[11] Patent Number: 4,841,125

[45] Date of Patent: Jun. 20, 1989

[54] CONTROL UNIT FOR A HEATING SYSTEM WITH MEMORY MEANS

[75] Inventor: Kaoru Edamura, Nara, Japan

[73] Assignee: Sharp Kabushiki Kaisha, Osaka, Japan

[21] Appl. No.: 212,040

[22] Filed: Jun. 23, 1988

Related U.S. Application Data

[63] Continuation of Ser. No. 80,221, Jul. 31, 1987, abandoned, which is a continuation of Ser. No. 875,588, Jun. 18, 1986, abandoned.

[30] Foreign Application Priority Data

| | | | |
|---|---|---|---|
| Jul. 18, 1985 | [JP] | Japan | 60-110056[U] |
| Aug. 12, 1985 | [JP] | Japan | 60-124262[U] |
| Oct. 15, 1985 | [JP] | Japan | 60-1588441[U] |
| Dec. 12, 1985 | [JP] | Japan | 60-191706[U] |

[51] Int. Cl.[4] ..... H05B 1/02

[52] U.S. Cl. ..... 219/506; 219/492; 219/508; 219/10.55 B; 364/705; 426/243; 426/523

[58] Field of Search ..... 219/494, 492, 490, 508, 219/506, 10.55 B; 364/705, 710, 684, 400, 709; 235/435, 492; 426/243, 523

[56] References Cited

U.S. PATENT DOCUMENTS

| | | | |
|---|---|---|---|
| 4,336,433 | 6/1982 | Yokozeki | 219/10.55 B |
| 4,339,646 | 7/1982 | Doi et al. | 219/10.55 B |
| 4,345,132 | 8/1982 | Takase et al. | 219/10.55 B |
| 4,375,586 | 3/1983 | Veda | 219/10.55 B |
| 4,450,345 | 5/1984 | Hotta et al. | 219/10.55 B |

*Primary Examiner*—M. H. Paschall

*Attorney, Agent, or Firm*—Flehr, Hoh bach , Test, Albritton & Herbert

[57] ABSTRACT

A control unit for a heating system such as a microwave oven comprises a RAM into which cooking programs of many menus are transferred from one of a plurality of available external memory modules. Data related to the cooking programs are displayed in a display window sequentially or in small units and the user can operate input keys to select a desired menu. The number of times each menu has been selected is stored and can be displayed.

18 Claims, 20 Drawing Sheets

CONTROL UNIT FOR A HEATING SYSTEM WITH MEMORY MEANS

This is a continuation of application Ser. No. 080,221 filed July 31, 1987, now abandoned, which is a continuation of application Ser. No. 875,588 filed June 18, 1986, now abandoned.

BACKGROUND OF THE INVENTION

This invention relates to a control unit for a heating system such as a kitchen oven or a commercial microwave oven used at a fast-food store, and more particularly to such a control unit which contains a microcomputer and operates in accordance with one of many stored programs or an inputted cooking sequence.

There is shown in FIG. 1 how the control unit of a typical commercial microwave oven at a fast-food store may look. A characteristic of such a commercial microwave oven at a fast-food store is that the types of foods which can be handled are usually limited (such as hamburgers) and that they can be served fast (such as within three minutes or five minutes). Reference being made to FIG. 1, numeral 51 indicates a display window for displaying information on the cooking sequence program which is being carried out. A liquid crystal or fluorescent tube may be used for this purpose and the displayed information may include a code number 54 assigned to the particular program currently being carried out and the remaining time of heating 55*a*. Numerals 52 indicate dedicated keys addressed to the individual menus offered by the system. Numeral 53 indicates a start key for starting the operation of the system according to the menu addressed by one of the dedicated keys 52. Each dedicated key 52 includes a number display section 52*a*, a menu name display section 52*b* and a key pad (input key) 52*c*.

Such a commercial microwave oven at a fast-food store must be easy to operate. For this reason, cooking programs for items handled at the store are usually incorporated in the control unit. Another characteristic of a microwave oven at a fast-food store is to store within the system itself a few kinds of food items such that a small variety of their combinations can be made according to the customer's choice. In the case of a hamburger store, one of the choices may be between a hamburger and a cheeseburger, or relate to the size such as "standard", "jumbo" and "mini". A commercial microwave oven at a fast-food store usually incorporates five to ten different programs. In most cases, a key is dedicated to each program as shown in FIG. 1 such that the user needs only to select a program and press the corresponding key once. In fast-food stores where each second counts, it is essential that the microwave oven be operable with one touch of a key. For this reason, it has been a common practice to store various cooking programs in a ROM means which has been made an inseparable part of the control unit.

Although the number of choices is limited in most such applications, there can be popular (frequently used) choices as well as unpopular (not so frequently used) choices. If the store wants to replace an unpopular menu with a new menu developed at the store itself, however, the existing program already incorporated in the system cannot be utilized. From the point of view of the oven maker, on the other hand, it is not economically beneficial to receive many small orders from different types of businesses. In short, the consumers nowadays welcome the quick services of fast-food stores but at the same time want varieties and options, and the fast-food stores must keep creating new menus in order to survive in this world. In other words, there is a need for commercial microwave ovens of a new type which can be profitably used by fast-food stores with such requirements as described above.

With the recent progress in integrated circuits (IC) technologies, the memory capacities of individual IC memories have increased and the number of cooking sequence programs which can be stored in the electronic control unit of an ordinary microwave oven has also increased. The user nowadays can select a program from a large number of available menus. The control unit of such a microwave oven usually operates in the following two-step sequence. In the first step, the user selects a menu. In the second step, a cooking sequence program corresponding to the selected menu is retrieved. The first step is for the user to decide. With respect to the second step, a commonly adopted method has been to assign program codes to the individual cooking sequence programs of each menu such that the user operates the number keys on a panel to input a code number to access the desired cooking sequence program. Although it was usually the housewife's job to select the daily menus for the family, an increased number of women go out to work nowadays and such working wives do not have much time to plan a nutritiously balanced menu on an everyday basis. Some menus are very often repeated at frequent intervals but it is not easy for the planner of a meal to remember when it was the last time the same plate was prepared before. For this reason, the tendency is to repeat whichever menus that are familiar to him or her in spite of the large variety of cooking sequence programs available with the system. In other words, a large fraction of the many programs edited by the oven maker tends to remain unused. Although the number of programs that can be offered with an oven may further increase in the future, the number of access keys dedicated to the individual programs is limited by the physical size of the control unit. This means that the user would still have to memorize the program codes or to keep consulting the menu book listing the codes.

SUMMARY OF THE INVENTION

In view of the various problems and disadvantages of the prior art control units of heating systems such as family or commercial microwave ovens, it is an object of the present invention to provide a control unit for a heating system which can distinguish frequently used cooking sequence programs from rarely used ones such that new programs can be inputted and unused programs can be deleted easily.

It is another object of the present invention to provide a control unit of a microwave oven which allows the user to select a balanced menu without much trouble.

It is still another object of the present invention to provide a control unit of a heating system such as a microwave oven with which unused programs can be prevented from accumulating and the user need not memorize any program codes.

It is a further object of the present invention to provide a control unit of a heating system such as a microwave oven with which the user can determine how the provided cooking programs are being used and obtain information which may suggest a change in the composition of the cooking programs.

The above and other objects of the present invention are achieved by providing a control unit for a heating system such as a microwave oven which embodies the present invention. According to one embodiment of the present invention, the control unit comprises a RAM divided into memory regions each with an assigned address such that cooking programs stored as data on an external memory module can be transferred to the RAM at designated addresses. Keys which are individually associated to these addresses are provided and serve to designate the addresses where data from a module should be transferred in the RAM and also to specify an address such that the data at the specified address are displayed by a display means. A control circuit which controls all operations of the control unit also serves to display the number of times any of the specified programs has been used. Since a plurality of memory modules can be provided, each being removably attachable to the control unit to transfer its data into the RAM, and since each address is represented by a separate key, the operation of the system is simplified and rarely used programs can be easily replaced by new programs merely by inserting a new module.

According to another embodiment of the present invention, a menu selection aid unit, which is removably attached to the control unit, includes a first memory means which stores a plurality of cooking programs inclusive of data associated with each program such as the main ingredient, how long it will take to cook and the method of heating. Such data are sequentially displayed and the user chooses a program by removing response-inputting knobs to desired positions to pick out answers from such displayed data. The number of times each program has been used is stored in a second memory means and can be displayed. This aid unit, unlike the memory module of the previous embodiment, can be operated independently of the control unit and assist the user in picking a menu on the basis of a systematic rational analysis.

According to still another embodiment of the present invention, the control unit comprises a RAM for storing data, a display means and a control circuit with input means. Cooking programs inclusive of various data associated therewith are transferred from external memory means to the RAM and such programs are displayed sequentially in small units such as four programs at a time. The user can thus obtain data on such candidate menus and select a menu on the basis thereof. The unit also serves to keep track of the number of times each program has been used and can be caused to display such information in response to a command by the user. In summary, control units of the present invention are easy to operate and can assist the user in selecting a menu on a rational basis. Even if a bug is found in a program, the maker does not have to recall the entire product but has only to supply a new module with the program corrected.

BRIEF DESCRIPTION OF THE DRAWINGS

The accompanying drawings, which are incorporated in and form a part of the specification, illustrate several embodiments of the present invention and, together with the description, serve to explain the principles of the invention. In the drawings.

DETAILED DESCRIPTION OF THE INVENTION

Figure 1:
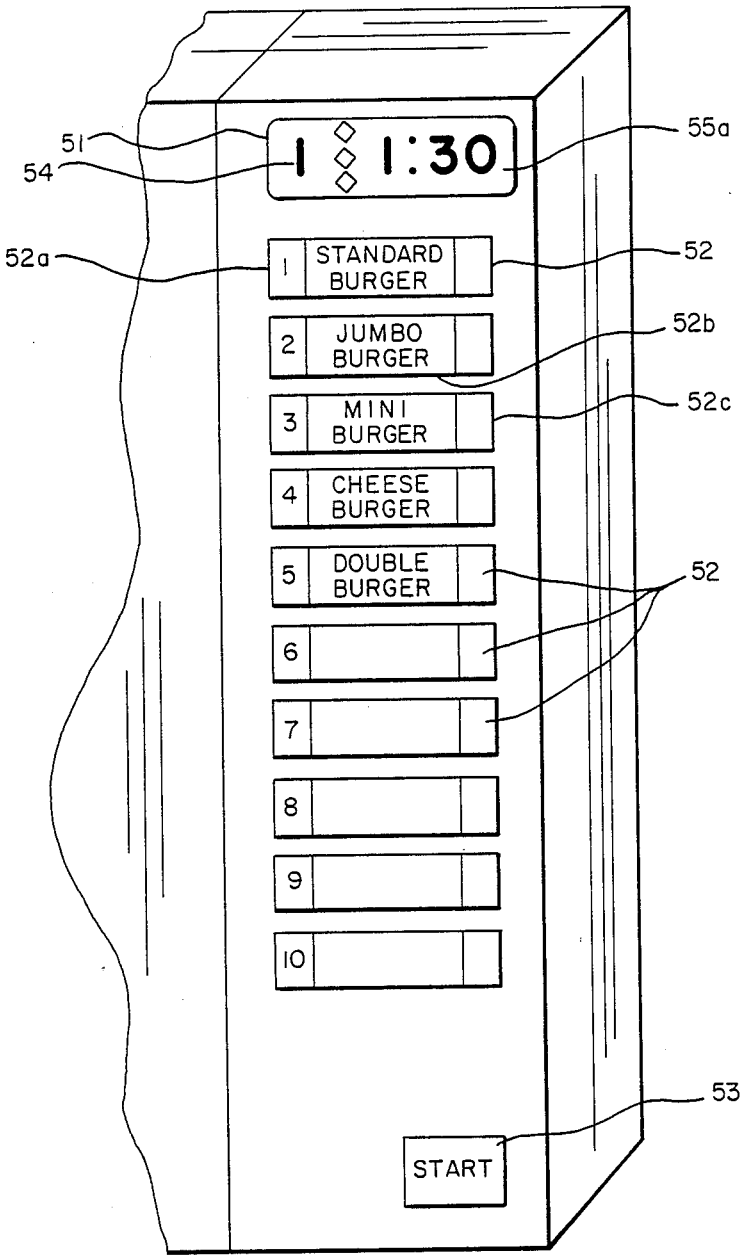
PRIOR ART FIG. — 1
FIG. 1 is a perspective view of a control unit of a prior art microwave oven.
Figure 2:
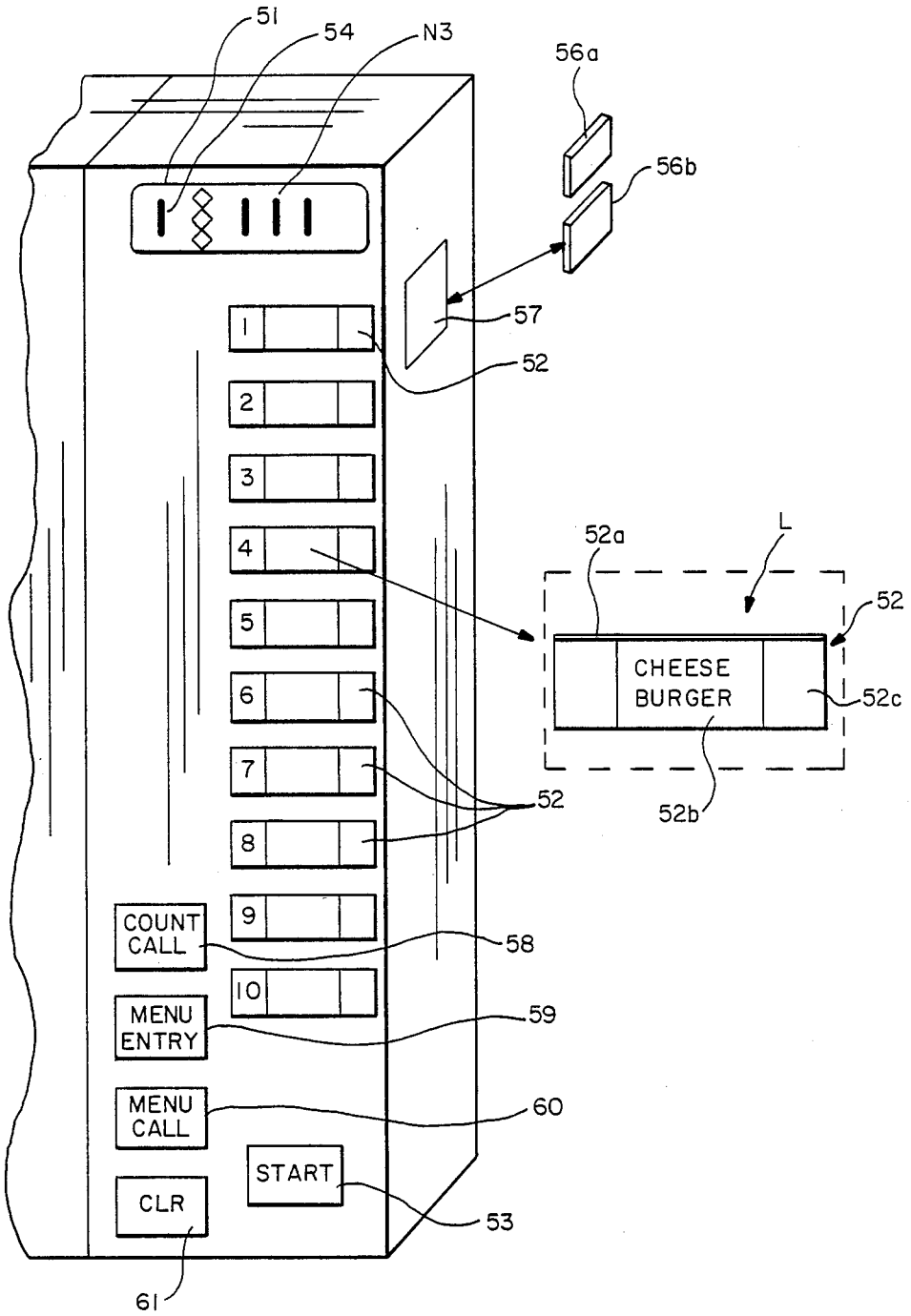
FIG. 2 is a perspective view of a control unit of a microwave oven according to one embodiment of the present invention.

A control unit according to one embodiment of the present invention is shown in FIG. 2. Since this unit is based on the prior art unit explained above by way of FIG. 1, components identical to those shown in FIG. 1 are indicated by the same numerals. Thus, reference being made now to FIG. 2, numeral 51 again indicates a display window for displaying information on the cooking sequence program presently being performed, having a liquid crystal, a fluorescent tube or the like as the display element. Each numeral 52 indicates a key dedicated to a menu and numeral 53 indicates a start key for starting the operation of the associated microwave oven by the program addressed by one of the dedicated keys 52. Reference being made additionally to FIG. 4(*c*), numeral 54 is a key number and numeral 55*a* indicates the remaining heating time and they are both displayed in the display window 51. Each dedicated key 52 comprises a key number display section 52*a*, a menu name display section 52*b* and a key pad (input key) 52*c*.

Figure 3:
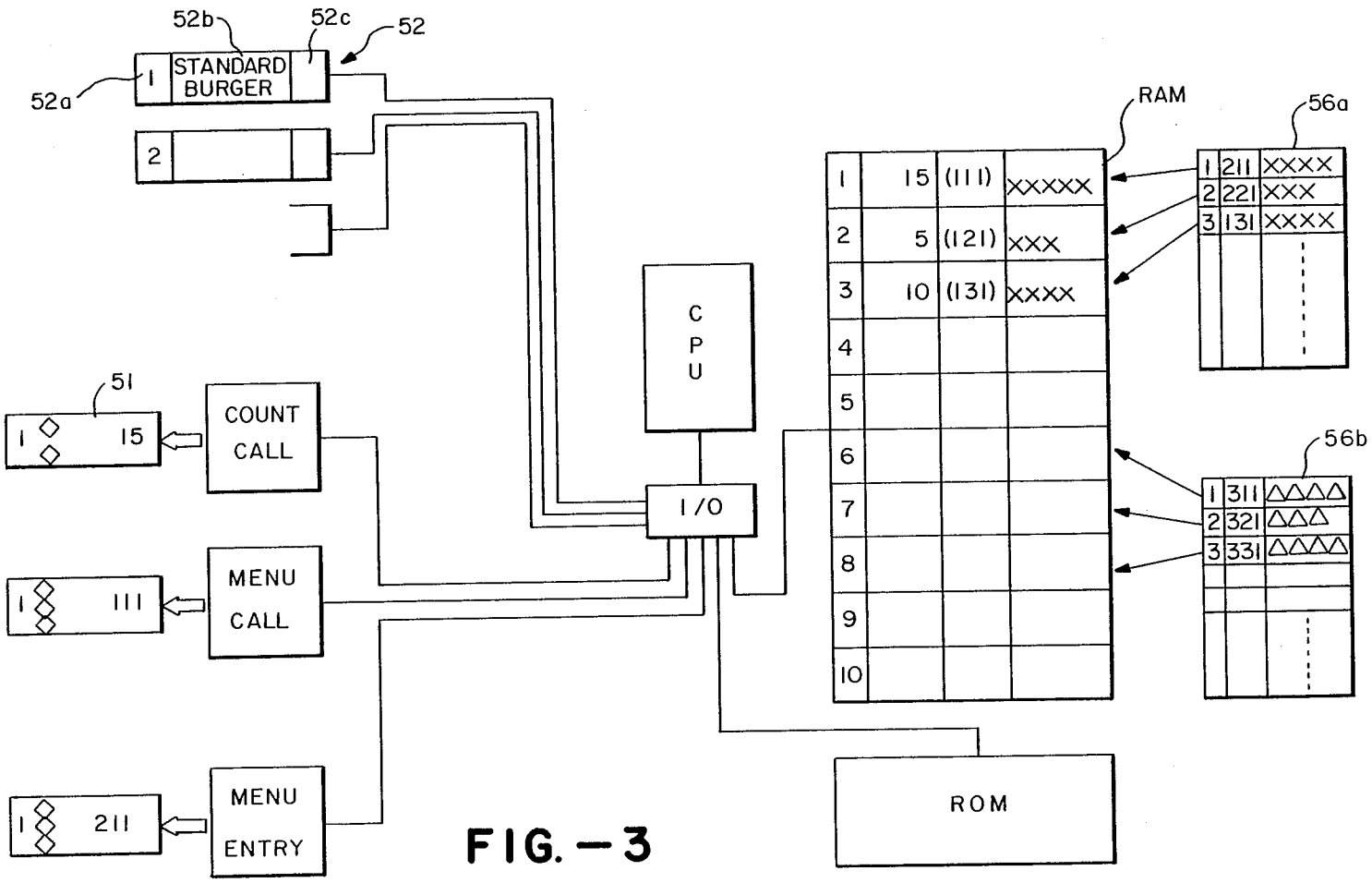
FIG. 3 is a block circuit diagram of the control unit of FIG. 2.
Figure 4A:
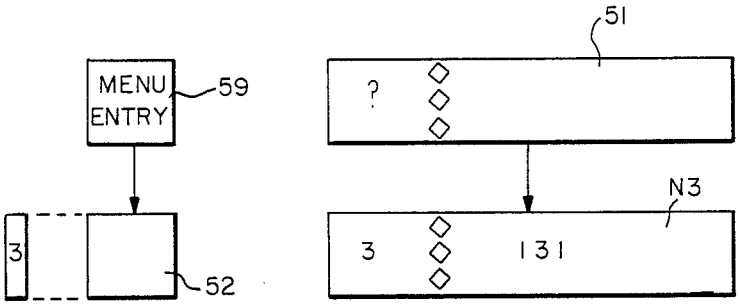
FIG. 4 is a group of drawings showing various key operations and displays made in the display window of FIG. 2.
Figure 4B:
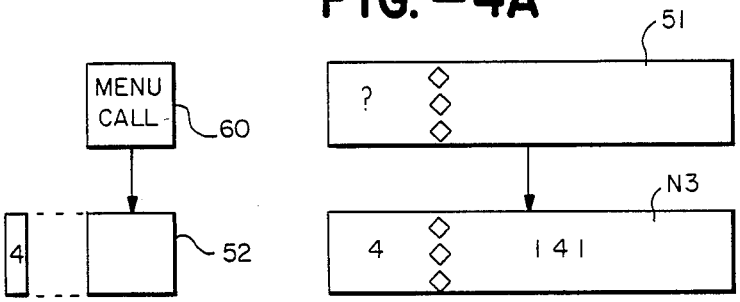
Figure 4C:
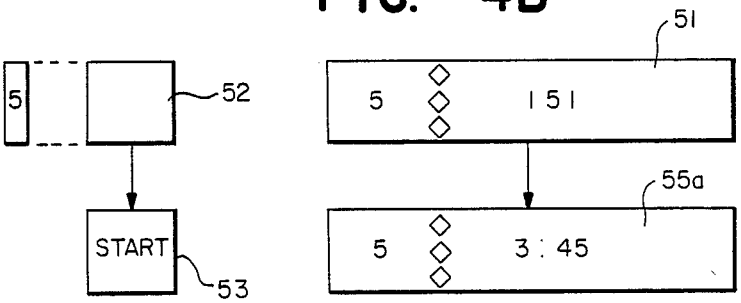
Figure 4D:
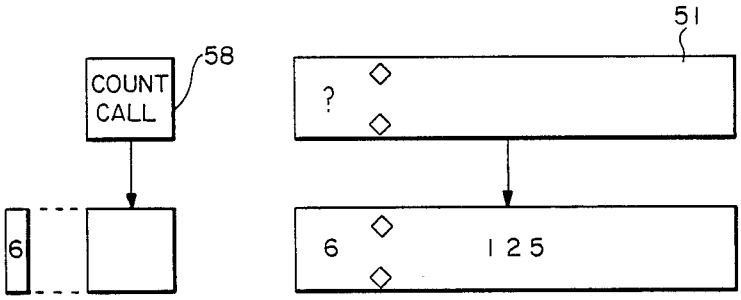

FIG. 3 is a block circuit diagram for the control unit of FIG. 2, wherein the corresponding components defined in connection with FIG. 2 are indicated by the same numerals. Reference being now made concurrently to FIGS. 2 and 3, numerals 56*a* and 56*b* indicate a plurality of modules (external memories) of cooking sequence programs contained in the form of a ROM or a battery-backed RAM. Numeral 57 indicates an access panel to be opened and closed when the module 58*a* or 56*b* is installed or removed. Numeral 58 indicates a count-calling (COUNT CALL) key for inputting a command to retrieve from a memory means the number of times a specified one of the dedicated keys 52 has been used and to have it displayed in the display window 51. Numeral 59 indicates a program-inputting (MENU ENTRY) key for specifying to a RAM by a command of a central processing unit (CPU) such as a microcomputer that the loading of a cooking sequence program P from the aforementioned module 56*a* or 56*b* be executed. Numeral 60 indicates a program-code-outputting (MENU CALL) key for displaying in the display window 51 the code N3 of the program P stored at the RAM address corresponding to a specified one of the dedicated keys 52 so that the user can verify whether the content of the program correctly matches the menu name on the menu label L for that dedicated key 52.

With the count-calling key 58, the program-inputting key 59 and the program-code-outputting key 60 provided additionally, the control unit of FIG. 2 can display not only (A) the code number N3 of the program loaded at the memory address N1 corresponding to a specified dedicated key 52 but also (B) the number of times N2 the given dedicated key 52 has been used. According to a preferred embodiment of the present invention, the ROM contains a display program according to which three diamond-shaped symbols appear vertically aligned between the key number 54 and the numerical information as shown in FIG. 2 and FIG. 4(*a*) when a code number N3 is displayed in the display mode (A), but two such symbols appear as shown in FIG. 4(*d*) in the other display mode (B) defined above. In other words, the user can understand the meaning of the displayed numeral by counting the number of diamond-shaped symbols which precede it.

Figure 5:
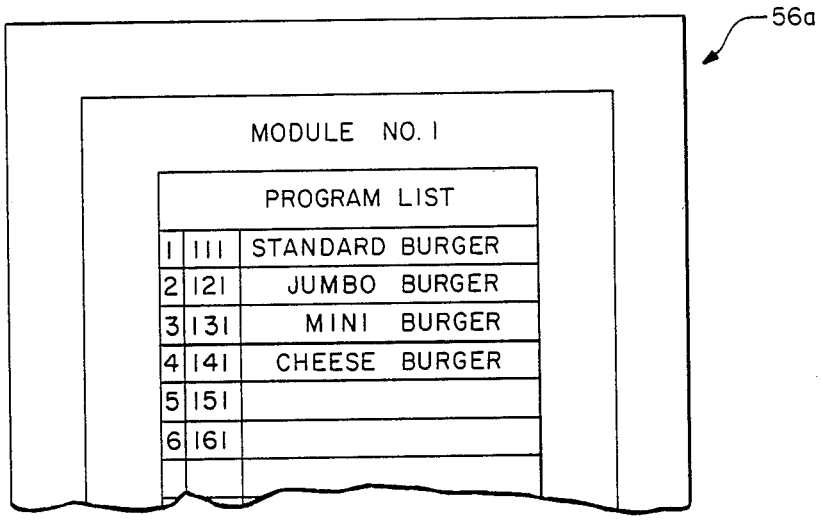
FIG. 5 is a front view of an external memory module.

To summarize the explanation given above, the control unit of FIG. 2 does not store any cooking sequence program directly within itself. Instead, it is provided with a RAM means (RAM of FIG. 3) for the user to catalog information in and cooking sequence programs are supplied in the form of an external memory means 56 such as a ROM module or a battery-backed RAM module. Such an external memory means (56*a*) is illustrated in FIG. 5.

Let us consider a user who has just purchased a microwave oven illustrated above and modules 56*a* and 56*b*. A method of loading the sequence programs provided in the modules 56 is explained next by way of FIGS. 2 and 4 as well as FIG. 6 which is a flow chart for the loading operation. First, the module containing the largest number of sequence programs is selected as the one to form a basis for the sequence construction and all programs contained in this module are loaded in the RAM (called "simple SWAP" in FIG. 6). The user opens the module access panel 57 on the control unit to install the selected module and then presses the program-inputting (MENU ENTRY) key 59 once. This causes the microcomputer inside the control unit to select the program-inputting mode of operation. When the program-inputting (MENU ENTRY) key 59 is pressed again, simple SWAP (replacement of all programs) is selected as the input mode and the programs in the module are loaded. As a result, the RAM in the control unit may look, for example, as shown in FIG. 7(*a*).

Figure 6:
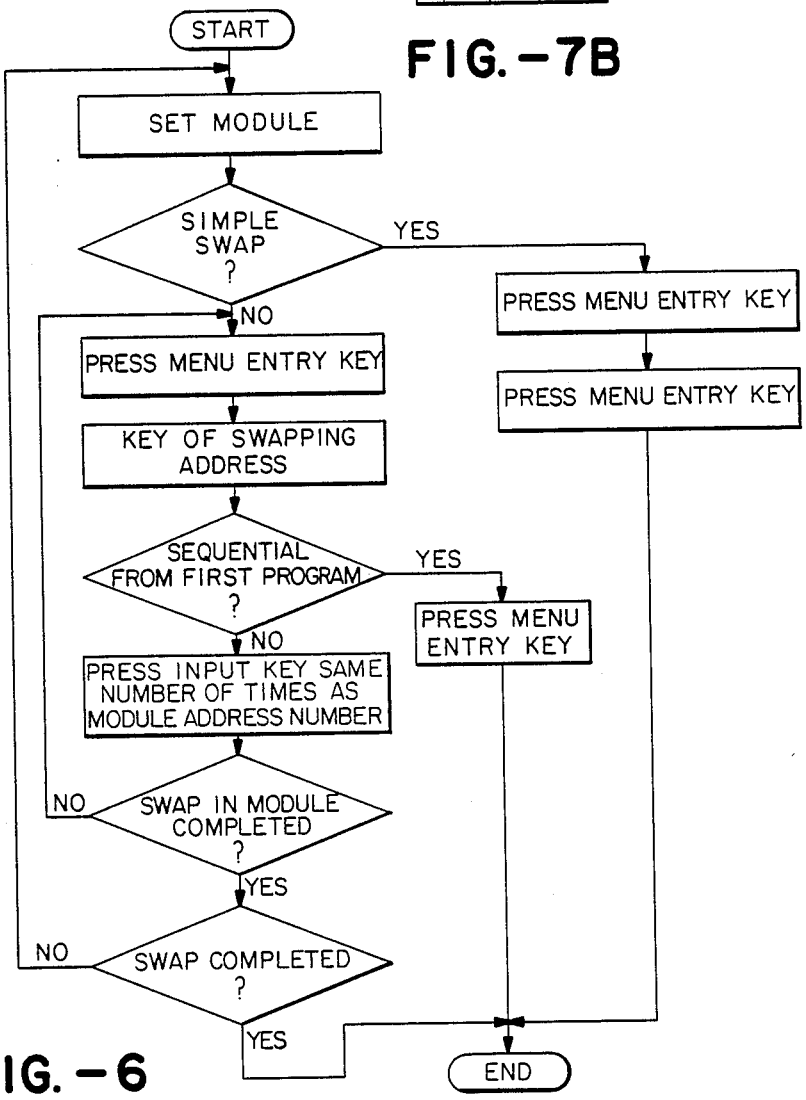
FIG. 6 is a flow chart for the cataloging of sequence programs from external module to a RAM in the control unit of FIG. 2.

According to a method shown in the flow chart of FIG. 6, it is possible to replace a bottom portion of the RAM (one of the middle addresses and all subsequent addresses) with programs from another module. This process will be explained next by way of an example shown in FIG. 7(*a*). After the first module 56*a* is replaced by the second module 56*b* in the control unit, the program-inputting (MENU ENTRY) key 59 is pressed once. Next, the dedicated key 52 corresponding to the first address of the areas where programs are to be replaced is pressed. In the example of FIG. 7(*a*), the dedicated key 52 having "6" as the key number should be pressed and, since the first five programs in the module 56*b* are intended to be loaded into the RAM as shown by five arrows in FIG. 7(*a*), the program-inputting (MENU ENTRY) key 59 is pressed again as shown by FIG. 6.

Figure 7A:
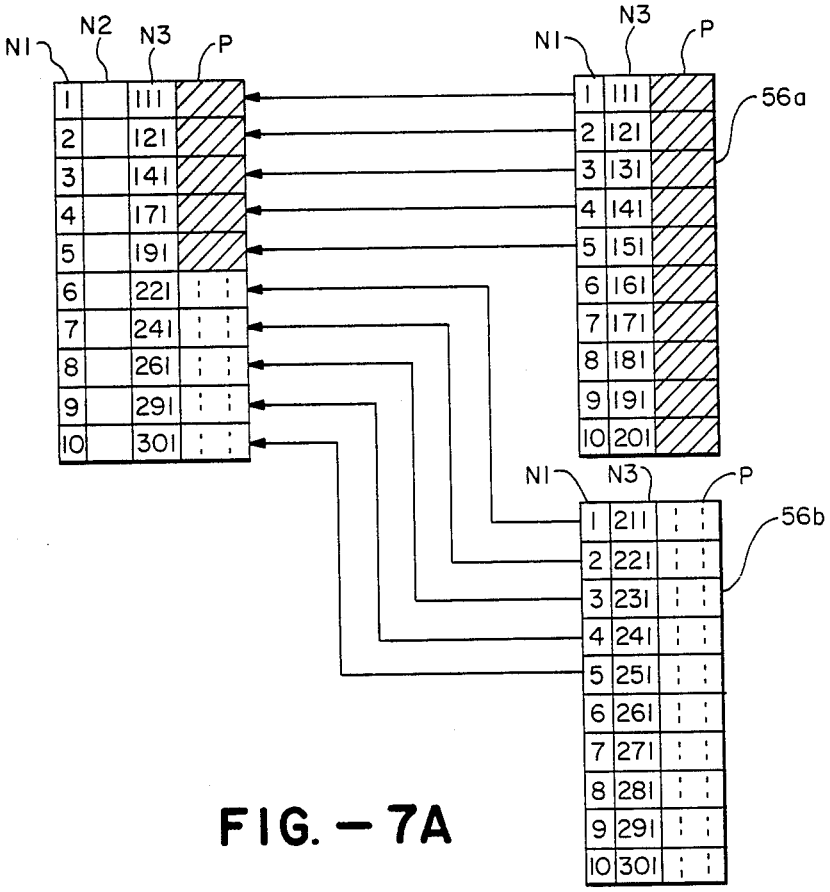
FIG. 7 is a drawing for showing merge cataloging.
Figure 7B:
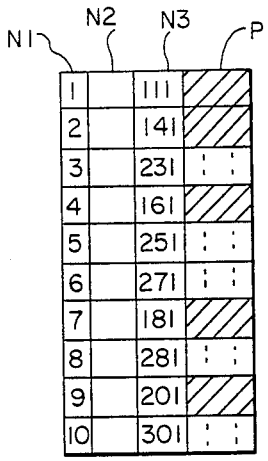

FIG. 7(*b*) shows an example of composite merge whereby the program at a specified address in the RAM is replaced by a particular program at another specified address in a (ROM or battery-backed) module. This procedure is used, for example, for replacing a rarely used cooking procedure program by a new program and is effected by pressing firstly the program-inputting (MENU ENTRY) key 59, secondly the dedicated key 52 corresponding to the program to be replaced and thirdly the dedicated key as many times as the address number for the program to be entered. For example, if its address number is 8, the key must be pressed eight times.

Next, a method of checking whether a loaded program has really been loaded correctly is explained. As shown in FIG. 5, a list of contained programs is attached to each (ROM or battery-backed RAM) module 56*a* and each program is assigned a program code N3 as explained above. Thus, the user can check the content of each loaded program by calling its program code N3 to have it displayed in the display window 51. This is accomplished by pressing firstly the program-outputting (MENU CALL) key 60 and secondly the dedicated key 52 corresponding to the program to be checked.

Reference being made to the example shown in FIG. 4(*b*), the mark "?" appears at the left-hand end of the display window 51 when the program-outputting (MENU CALL) key 60 is pressed. This means that the user is being asked to specify a key number. If the user presses the fourth dedicated key 52 (having "4" in the key number section 52*a*), "4" appears instead of "?" and "141" as the corresponding code N3 is displayed on the right-hand side of three vertically aligned diamond-shaped symbols. By consulting the list on the label pasted on the module as shown in FIG. 5, the user can learn that the program being checked is for a cheeseburger.

Next, a method of checking a number of times each dedicated key has been used will be explained. Although it is not shown in FIG. 3, it is to be understood that each number N2 of times (or the count) the corresponding program has been used is updated whenever the execution of the program is completed and a drive signal is transmitted to an electronic buzzer to announce the completion. In order to check the count, the count calling (COUNT CALL) key 58 should be pressed. This causes two vertically aligned diamond-shaped symbols to appear as shown in FIG. 4(*d*) and a symbol "?" on the left-hand side thereof, indicating that the used is being requested to specify a program number. If the user presses the dedicated key 52 with key number "6" at this point, the symbol "?" is replaced by ("6"), representing the program number of the selected program and "125", for example, indicating that the sixth program stored now in the RAM has been used 125 times.

In summary, the control unit for a heating system according to the above-described embodiment of the present invention is extremely easy to operate because cooking sequence programs can be preset in the form of a module and the user needs only to press a START key after pressing a dedicated key showing the name of the selected menu. Moreover, the user can easily find out how many times each of the preset programs has been used and replace rarely used programs with new programs by an equally simple operation.

Figure 8:
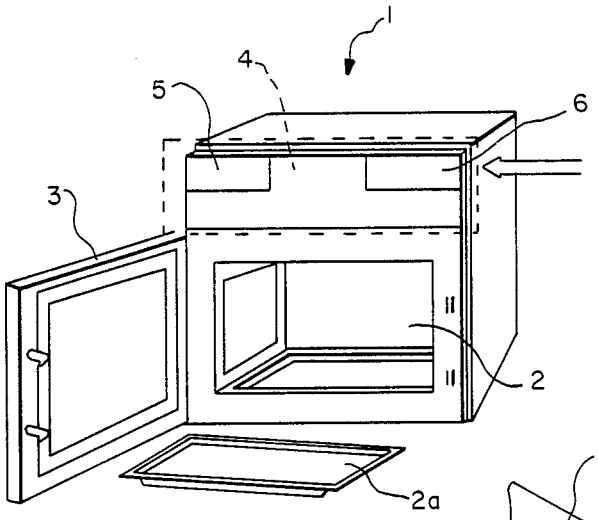
FIG. 8 is a perspective view of a microwave oven incorporating a control unit according to another embodiment of the present invention, FIGS. 9(*a*) and 9(*b*) are enlarged views showing how the menu selection aid unit of FIG. 8 is attached to the control unit.

Reference being next made to FIG. 8, there is shown a microwave oven 1 incorporating a control unit 4 according to another embodiment of the present invention. Numerals 2, 3, 5 and 2*a* respectively indicate a heating chamber, a door to the heating chamber, a display means for displaying inputted information and the mode of cooking and a tray adapted to be removably installed inside the heating chamber. Numeral 6 indicates a menu selection aid unit removably mounted on the top right-hand corner of the control unit 4.

Figure 9B:
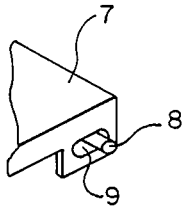
Figure 9A:
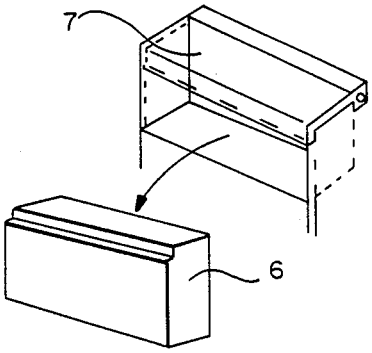

The aid unit 6 is what characterizes this embodiment of the present invention and is mounted to the control unit 4 as shown in FIGS. 9(*a*) and 9(*b*) by means of a cover 7 which holds its top part from the front surface. A protrusion 8 on the side edge of the control unit 4 is inserted through an elongate hole 9 provided near the back end of a side surface of the cover 7. This protrusion 8, together with the elongate hole 9, serves as a hinge such that the aid unit 6 can be removed from the control unit 4 by lifting the cover 7.

Figure 10:
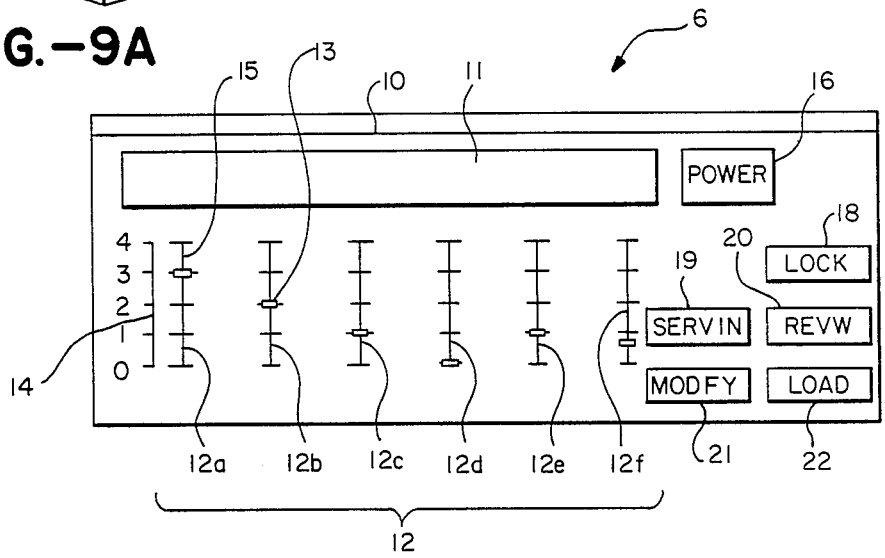
FIG. 10 is a perspective view of the front surface of the menu selection aid unit of FIGS. 8 and 9.

As shown in FIG. 10, the aid unit 6 is approximately of a rectangular box-like shape having a horizontal groove 10 along the top front edge such that the front edge of the attachment cover 7 will engage with it to hold the aid unit 6 securely against the control unit 4 as shown in FIG. 9(*a*). Numeral 11 indicates a display means such as a liquid crystal device of a dot matrix type such that characters and numbers can be easily displayed. Below the display means 11 are selection switch means 12. According to the embodiment shown in FIG. 10, there are six of such means 12*a*–12*f* each comprising a knob 13 which is slidable vertically along a groove 15. There is a numeric scale 14 indicating knob-setting positions corresponding to internal junction points (not shown). In other words, although the form of an analog switch is adopted, a signal corresponding to the set knob positions is outputted only when each of the knobs 13 is set at one of the discrete allowed positions. Since there are six switch means 12 each having five knob-setting positions 0–4, the selection switch means of FIG. 10 is equivalent to single-function switches arranged in a $5\times6$ matrix formation. The form of an analog switch has been adopted so that the knobs 13 remain in the set positions. This makes it easier for the user when it is desired to adjust the input conditions.

Reference being made still to FIG. 10, numeral 16, indicates a power switch and there are shown several function key switches which may be of a push button type. Numeral 18 indicates a lock key, numeral 19 indicates a quantity-specifying (SERVIN) key for specifying the number of servings, numeral 20 indicates a review (REVW) key, numeral 21 indicates a modifying (MODFY) key and numeral 22 indicates a program loading (LOAD) key. The functions of these keys are explained below.

Figure 11:
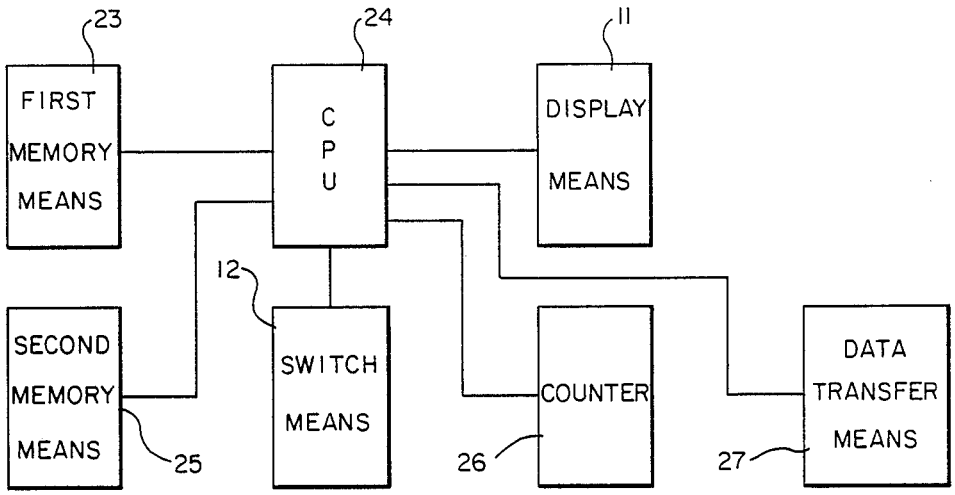
FIG. 11 is a block circuit diagram of the menu selection aid FIG. 10.

Reference being made next to FIG. 11 which is a block diagram of the aid unit 6, a first memory means 23 comprising ROMs or battery-backed RAMs is connected to the display means 11 through a central processing unit (CPU) 24. Numeral 25 indicates a second memory means which may comprise RAMs and serves to store selected information and other data. Numeral 26 indicates a counter which serves to count the numbers of times selected cooking menus have been used. Numeral 27 indicates a data transfer means for transferring cooking sequence data stored in the second memory means 25 to the control unit 4. Power is supplied to the aid unit 6 thus constructed from a battery or a dry cell (not shown) which may be put inside the aid unit 6 through a battery access panel (not shown) provided on the back surface of the aid unit 6. In other words, the aid unit 6 may be disconnected from the microwave oven 1 but can still independently operate all its functions except that of transferring data.

Figure 13D:
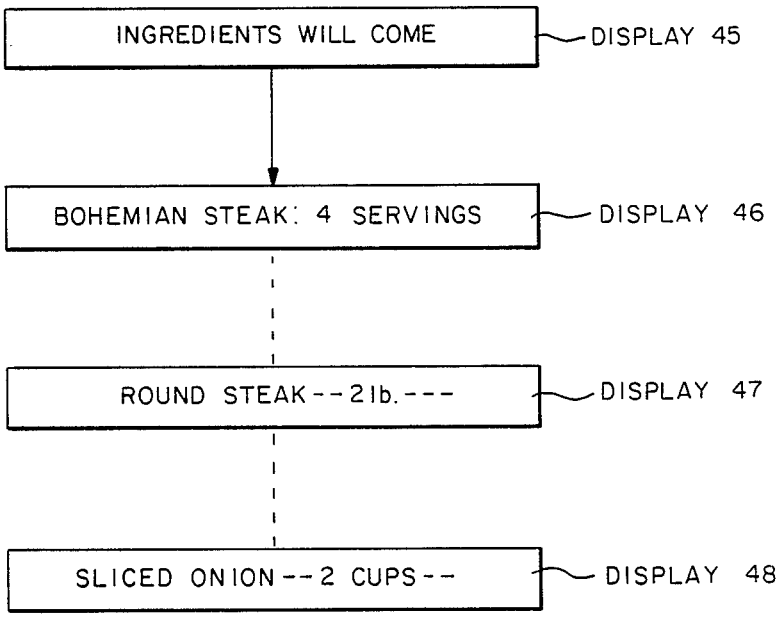

Operation of this aid unit 6 is explained next by way concurrently of the flow chart of FIG. 12 and display diagrams of FIG. 13.

Figure 12A:
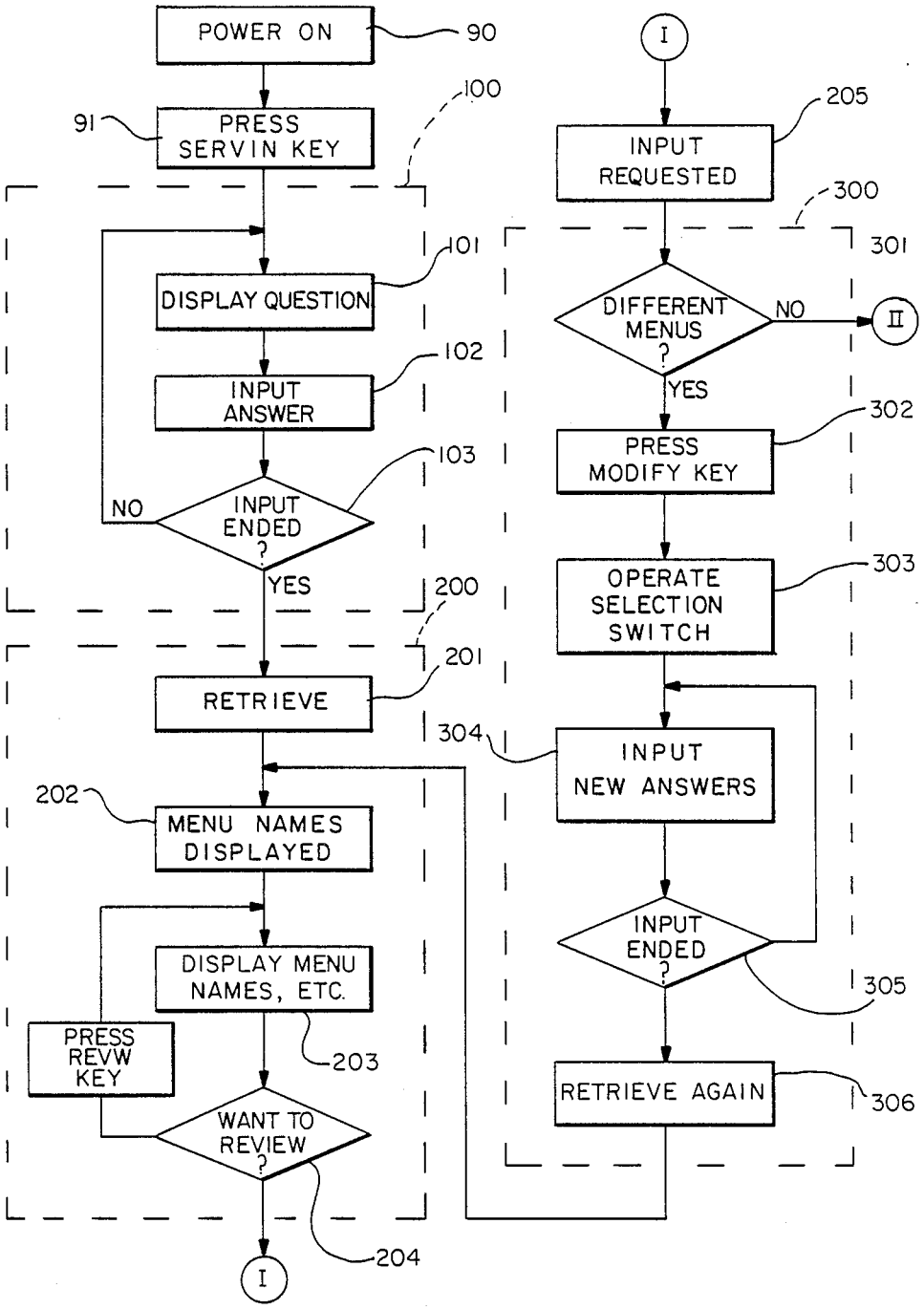
FIG. 12 is a flow chart for the operation of the menu selection aid unit of FIGS. 10 and 11, FIGS. 13(*a*)–(*d*) show displays made by the menu selection aid unit of FIGS. 10–12.
Figure 12B:
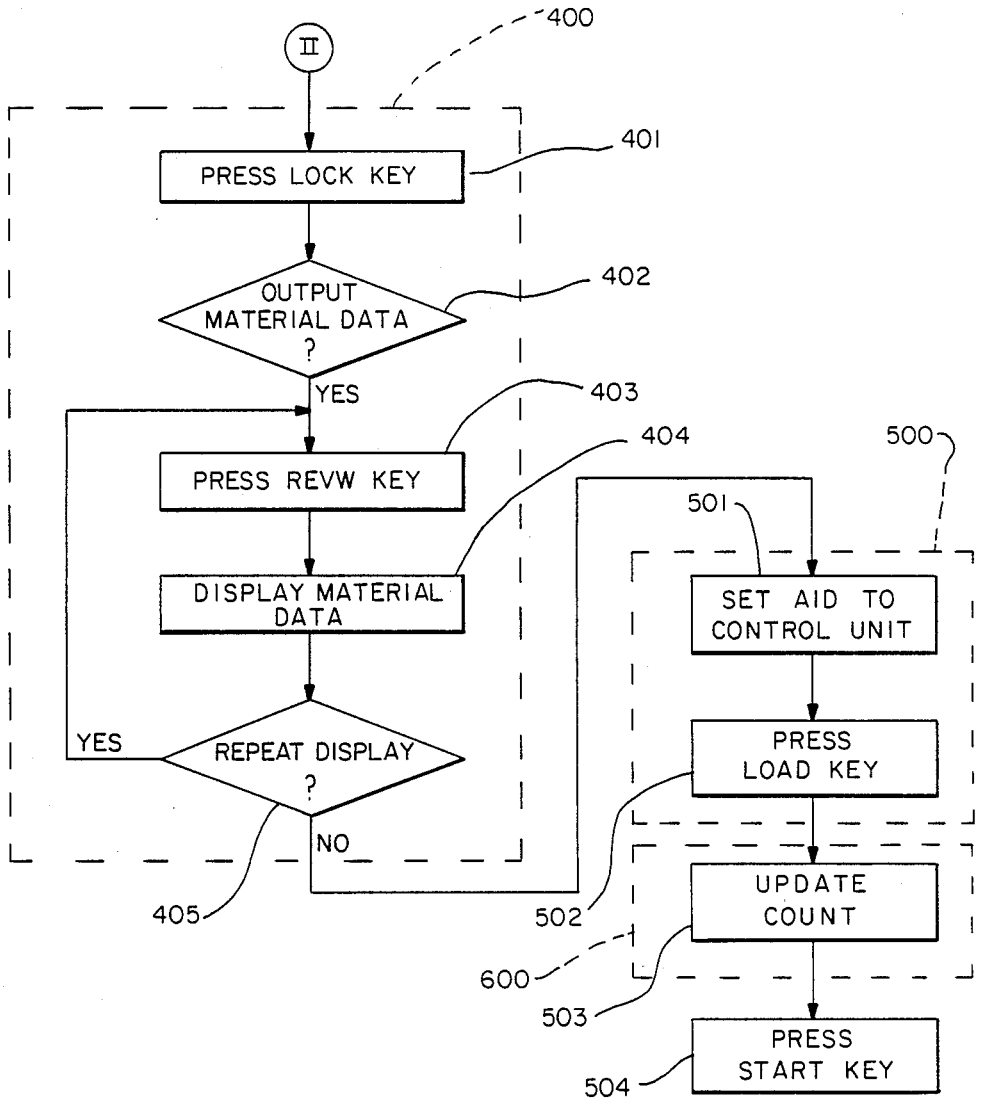
Figure 13A:
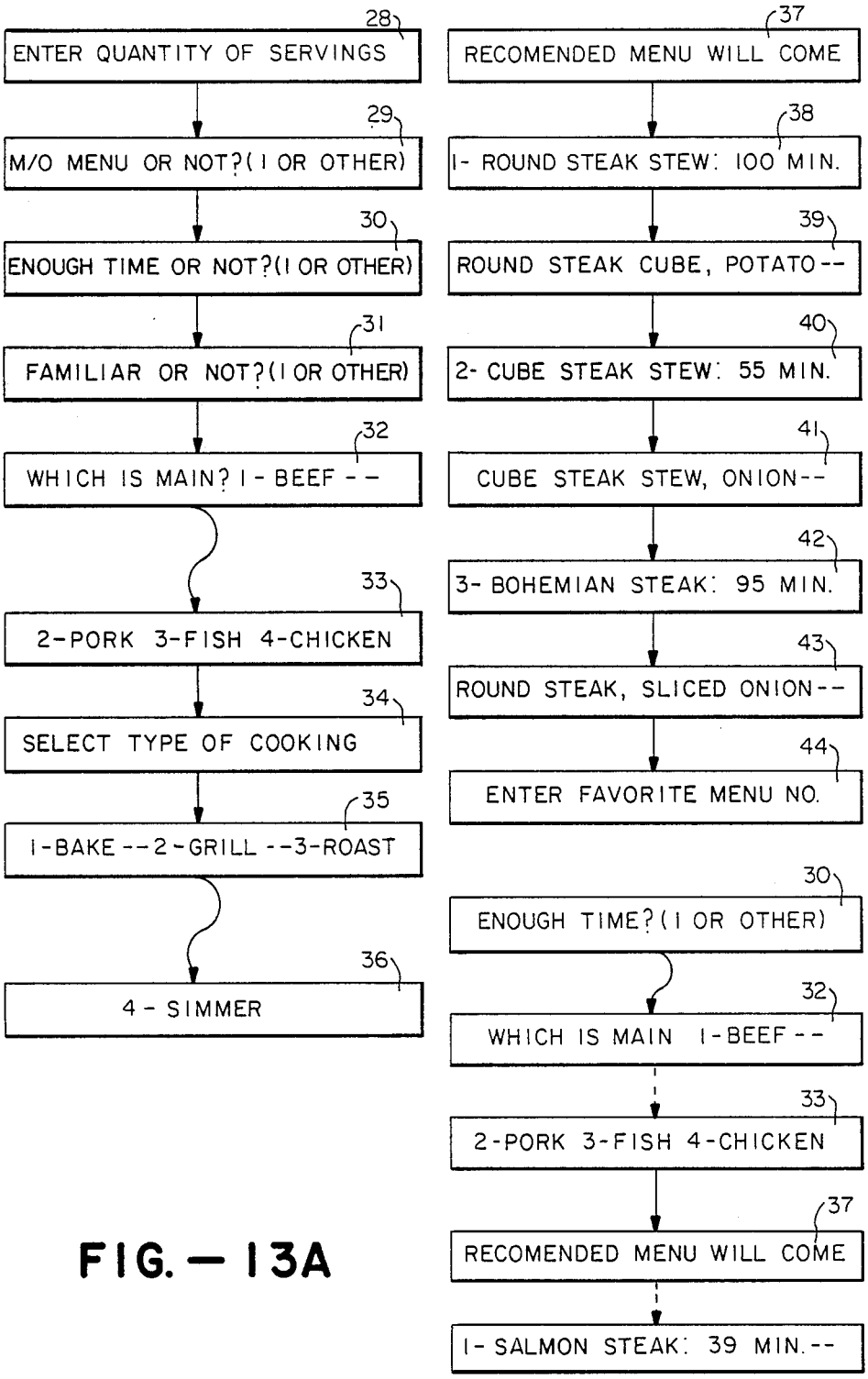

The process of operating the aid unit 6 according to this embodiment of the invention can be grouped approximately into the following stages with reference to FIG. 12; the automatic question display and response function (Stage 100), the recommended menu displaying function (Stage 200), the input data correcting function (Stage 300), the ingredient data outputting function (Stage 400), the program transfer function (Stage 500) and the counting function (Stage 0). When the user turns on the power switch 16 (Step 90) to operate the aid unit 6, the first question "ENTER QUANTITY OF SERVINGS" (Display 28) is displayed on the display means 11 as shown in FIG. 13(a). In response to this, the user presses the quantity-specifying (SERVIN) key 19 the same number of times as the desired number of servings (Step 91). The quantity-specifying key 19 is so set that a portion for one person is inputted if it is pressed once. When the specification of quantity is completed, the display means 11 automatically displays a question "M/O MENU OR NOT? (1 OR OTHER)" (Display 29), asking whether a menu using the microwave oven is desired for cooking or another type of heating such as for defrosting is intended (Step 101).

Subsequently, several questions, including the two described above, which relate to conditions of cooking in connection with the cooking program stored in the first memory means 23, are displayed sequentially in the display means 11 according to a predetermined order. The user responds to these questions by operating the five selection switch means 12a–12e, that is, by moving their knobs 13 to the desired positions indicated by the numeric scale 14 (Step 102). If the answer to Display 29 is "YES", this is effected by placing the knob 13 of the first selection switch means 12a at the position indicated by "1". If the answer is "NO", the knob 13 is set to a position other than "1". Next, a question "ENOUGH TIME OR NOT (1 OR OTHER)" (Display 30) is displayed, asking whether the user has enough time to spare for the cooking. A standard may be set, for example, at 50 minutes. If the user can afford this much time, the knob 13 of the second selection switch means 12b is set to "1". If the user's answer is "NO", the knob 13 is set to a position other than "1". This is followed in a predefined sequence by questions "FAMILIAR OR NOT? (1 OR OTHER)" (Display 31) which asks whether the menu in question has been tried before, "WHICH IS MAIN? 1-BEEF" (Display 32) and "2-PORK 3-FISH 4-CHICKEN" (Display 33) which relate to the main ingredient for the menu and "SELECT TYPE OF COOKING" (Display 34), "1-BAKE 2-GRILL 3-ROAST" (Display 35) and "4-SIMMER" (Display 36) which relate to the heating method. If the user desires a menu which has been tried before in response to Display 31, the knob 13 of the third selection switch means 12c is set at the position "1". If a new menu never tried before is desired, on the other hand, a position other than "1" must be selected. Thereafter, Displays 32 and 33 are displayed sequentially, asking a question. An answer is entered to this question by placing the knob 13 of the fourth selection switch means 12d to the position corresponding to the numerical value show in front of the desired material named. Similarly, the question posed through Displays 34, 35 and 36 is answered by placing the knob 13 of the fifth selection switch means 12e to the position corresponding to the numerical value shown in front of the desired heating method. At this moment, the control unit examines whether all required inputs have been made (Step 103). If the answer is "yes", the operation proceeds to Stage 200. This concludes the stage of suggesting menus.

According to the example used above for description of the present invention, answers can be selected from up to only four choices but this is not intended to limit the scope of the present invention. Regarding the selection of a heating method, for example, a fifth choice "5-RAW" may be added. Similarly, the variety in menus can be appropriately expanded. With respect to the choice for a new menu in response to Display 31, it goes without saying that completely new menus can be selected only in the beginning when the system is still new. After the system has been used many times and all the menus belonging to a category have been tried at lease once, relatively infrequently tried menus will be selected if "no" is inputted in response to Display 31.

After the user finishes inputting the cooking conditions, the central processing unit 24 considers the user's responses to Displays 28–36 and retrieves (Step 201) and displays (Step 202) up to three menus satisfying the user's conditions. An introductory statement "RECOMMENDED MENU WILL COME" (Display 37) is displayed first as shown in FIG. 13(*b*) and thereafter displays are made in the order or retrieval (Step 203) such as "1-ROUND STEAK STEW: 100 MIN" (Display 38), "ROUND STEAK CUBE, POTATO---" (Display 39), "2-CUBE STEAK STEW: 55 MIN" (Display 40), "CUBE STEAK STEW, ONION---" (Display 41), "3-BOHEMIAN STEAK: 95 MIN" (Display 42) and "ROUND STEAK, SLICED ONION---" (Display 43). After this series of displays is completed, the user decides whether the outputted information should be displayed again (Step 204). If the displays need not be reviewed, a message "ENTER FAVORITE MENU NO" (Display 44) is displayed, requesting the user to pick out one of the displayed menus (Step 205). If there are more than three menus that satisfy the user's conditions, those retrieved after the third are not outputted. If there are less than three menus satisfying the user's conditions, on the other hand, only those less than three menus are displayed.

Displays 38–43 are suggested, or recommended menus satisfying the user's conditions as inputted by the user himself or herself in the previous Stage 100. As can be seen in FIG. 13(*b*), not only the names of the menus but also the times required for preparation as well as the main ingredients required by the menus are displayed. These displayed data are intended to help the user in deciding which of the displayed menus should be selected in view of the time available, necessity for going out to buy materials, etc.

If one of the displayed menus appeals to the user, the knob 13 of the sixth selection switch means 12f is placed at the position corresponding to the number assigned to the menu in display. Data other than the menu thus selected are thereby erased.

If none of the recommended menus which have been displayed appeals to the user (YES in Step 301), the user must modify one or more answers previously given to questions outputted in the display means 11. For this purpose, the modifying (MODFY) key 21 is pressed (Step 302) and the knob 13 of the sixth selection switch means 12f is moved to the position "0". Of the remaining five selection switch means 12a–12e, those which need to be changed are similarly operated to bring their knobs 13 to the positions "0" (Step 303). If the knobs 13 of any of the selection switch means 12 are moved without initially pressing the MODFY key 21, however, the previous inputs will not be erased. In other words, the MODFY key 21 serves also as a safety means for preventing unintentional erasing or changes of the previous inputs through the selection switch means 12.

If one or more of the first five selection switches 12a–12e have been selected for a change and the corresponding knob or knobs 13 have been moved as explained above, questions corresponding to those selected selection switches 12 appear in the same sequential order in the display means 11. If the second selection switch 12b represents the first question (at farthest left in FIG. 10), "ENOUGH TIME? (1 OR OTHER)" (Display 30) is displayed for the second time in the display means 11 as shown in FIG. 13(*c*). The user responds to this question (Step 304) by moving the corresponding knob 13 appropriately as done in Stage 100. If two or more of the selection switches 12a–12e have been reset (by moving the knob to "0"), the question corresponding to the next switch is displayed (such as Displays 32 and 33 in the example of FIG. 13(*c*)). As soon as the central processing unit 24 thus determines that all inputs have been completed (Step 305), the step of retrieving menus satisfying the user's conditions is repeated (Step 30), this time, however, with a new set of conditions. Display 37 subsequently appears again as shown in FIG. 13(*c*). The processes thereafter are the same as explained above in connection with Step 202, etc.

Next, the ingredient data outputting function (Stage 400) of the aid unit 6 will be explained. As mentioned above, the menu selection aid unit 6 of the present invention can be removed from the control unit 4 to be used independently thereof. Since it also has the capability of displaying main ingredients of menus, the user may find it convenient to take it along to the grocery store as a guide. After the sixth selection switch means 12*f* is set to the position corresponding to a desired menu number and the lock (LOCK) key 18 is pressed (Step 401), the user determines whether data on the ingredients (referred to also as "material data" in FIG. 12 and elsewhere) should be displayed (Step 402). If this display is desired, the review (REVW) key 20 is pressed (Step 403). This will cause "INGREDIENTS WILL COME" (Display 45) to be displayed as shown in FIG. 13(*d*), followed by the name of the menu, the quantity or the desired number of servings, the names of the ingredients, and the quantities of the ingredients (Step 404) such as "BOHEMIAN STEAK: 4 SERVINGS" (Display 46), "ROUND STEAK---2 lb---" (Display 47) and "SLICED ONION---2 CUPS---" (Display 48). The user is asked then whether these ingredient data should be outputted again (Step 405) and if the user thinks it is unnecessary, the output of the ingredient data is ended. If otherwise, the user can review the output by pressing the REVW key 20. If the REVW key 20 is pressed at the end of Stage 100, the information related to the up to three recommended menus selected by the central processing unit 24 is displayed again.

Figure 14:
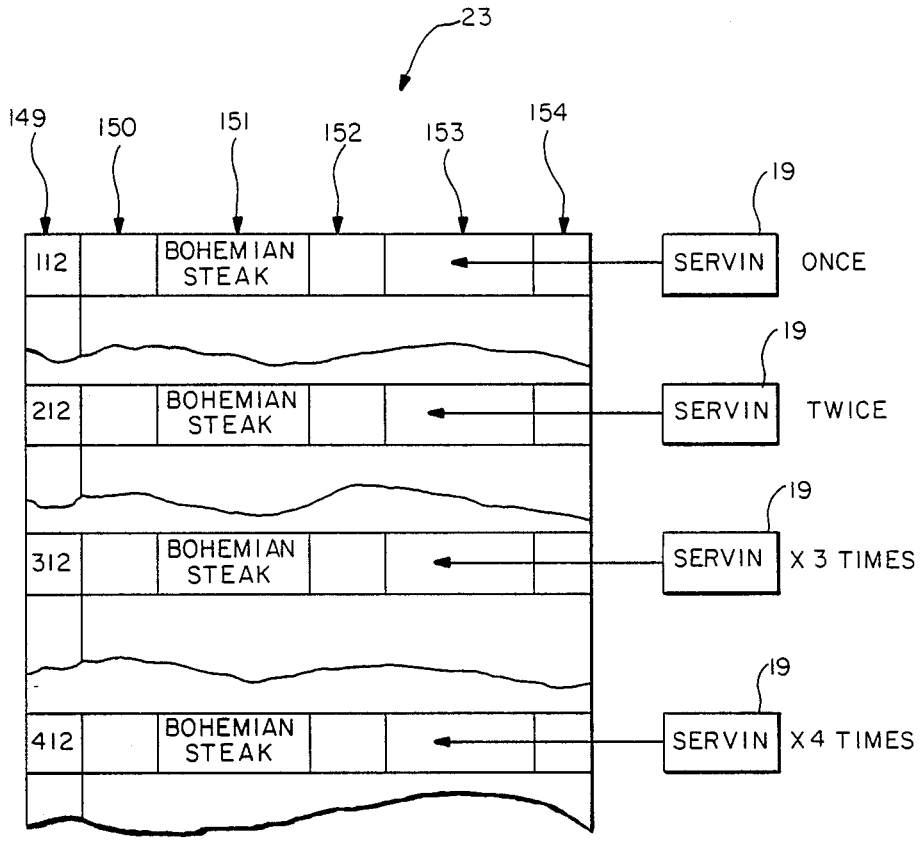
FIG. 14 is a diagram showing the data structure inside the first memory means of FIG. 11.

With respect to the above, the required quantities of the ingredients naturally depends on the number of portions. In other words, different cooking sequence programs corresponding to different quantities are necessary for the microwave oven. For this reason, the first memory means 23 is provided with both cooking menu data and cooking sequence data (programs) for different portions as shown in FIG. 14 such that the user can press the SERVIN key 19 a different number of times to select a correct address 149 in the first memory means 23 to be accessed. Reference being made to FIG. 14, data are stored in the order of retrieval condition 150, menu name 151, time required for cooking 152, data on ingredients 153 and cooking sequence program 154, and they are treated together as one unit of information.

Next, the program transfer function (Stage 500) is explained.

Figure 15:
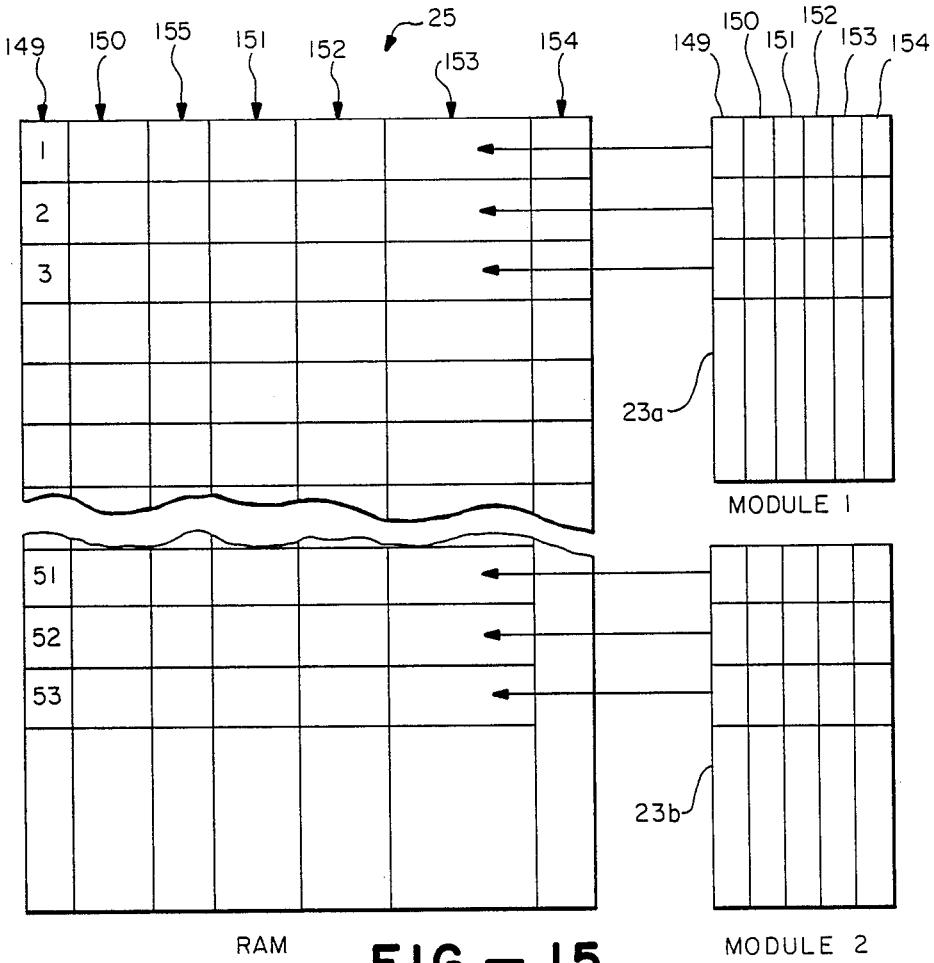
FIG. 15 is a diagram showing the data structure inside the second memory means of FIG. 11.

If the menu retrieved in Stage 200 (with reference to FIG. 12) relates to a cooking program, it includes a cooking sequence program according to which the microwave oven must be operated. Reference being made to FIG. 15 which shows the data structure in the memory means, numeral 23*a* indicates a first memory means in the form of a module (referred to as Module 1) storing menus in the manner described in FIG. 14. When the menu selection aid unit 6 is attached onto the control unit 4 (Step 501) as shown in FIGS. 8 and 9, the data stored in Module 1 are sequentially transferred into free regions in the second memory means 25. If the program loading (LOAD) key 22 is pressed thereafter (Step 502), the cooking sequence programs 154 which have been in the locked condition are transferred to the RAM in the control unit 4. In this situation, the LOAD key 22 functions also as a count key. In other words, 1 is added to the number stored in the column 155 to update the number of times the selected menu has been used (Step 502). The requested cooking process is started if the start key (not shown) on the control unit 4 is pressed at this moment (Step 504). In FIG. 15, numeral 23*b* indicates a module (Module 2) for menus which are not related to cooking by a microwave oven. If the user so desires, two modules of the same category may be installed instead in order to expand the scope of a limited category.

In summary, a microwave oven according to this embodiment of the invention includes a portable unit capable of suggesting menus on the basis of a rational analysis. This unit can be attached to the control unit of a microwave oven. If a menu requiring the use of the microwave oven is selected, a cooking sequence program can be inputted to the microwave oven easily by a simple operation after this unit is attached to it. Since this unit is provided in the form of an external memory element (ROM or battery-backed RAM module), a large variety of menu data can be made available by using more than one such unit.

A control unit for a heating system such as a microwave oven according to still another embodiment of the present invention is designed, as mentioned above, to prevent unused or rarely used cooking programs from accumulating and to enable the user to operate it without the necessity of memorizing program codes and the like. The microwave oven as a whole may look as shown in FIG. 8. The control unit 4 therein according to the present embodiment is described below with reference concurrently made to FIG. 16 which is its external view and FIG. 17 which is its block circuit diagram.

Figure 16:
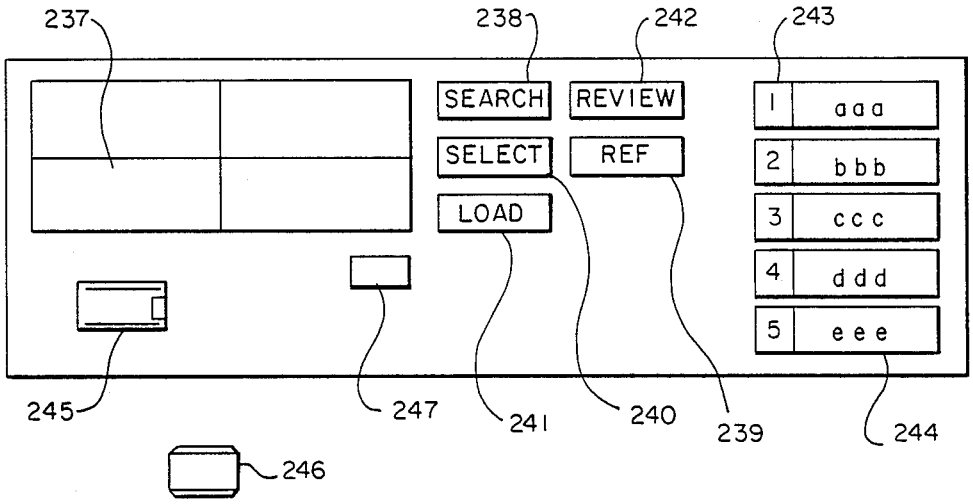
FIG. 16 is a front view of a control unit for a microwave oven of FIG. 8 according to still another embodiment the present invention.
Figure 17:
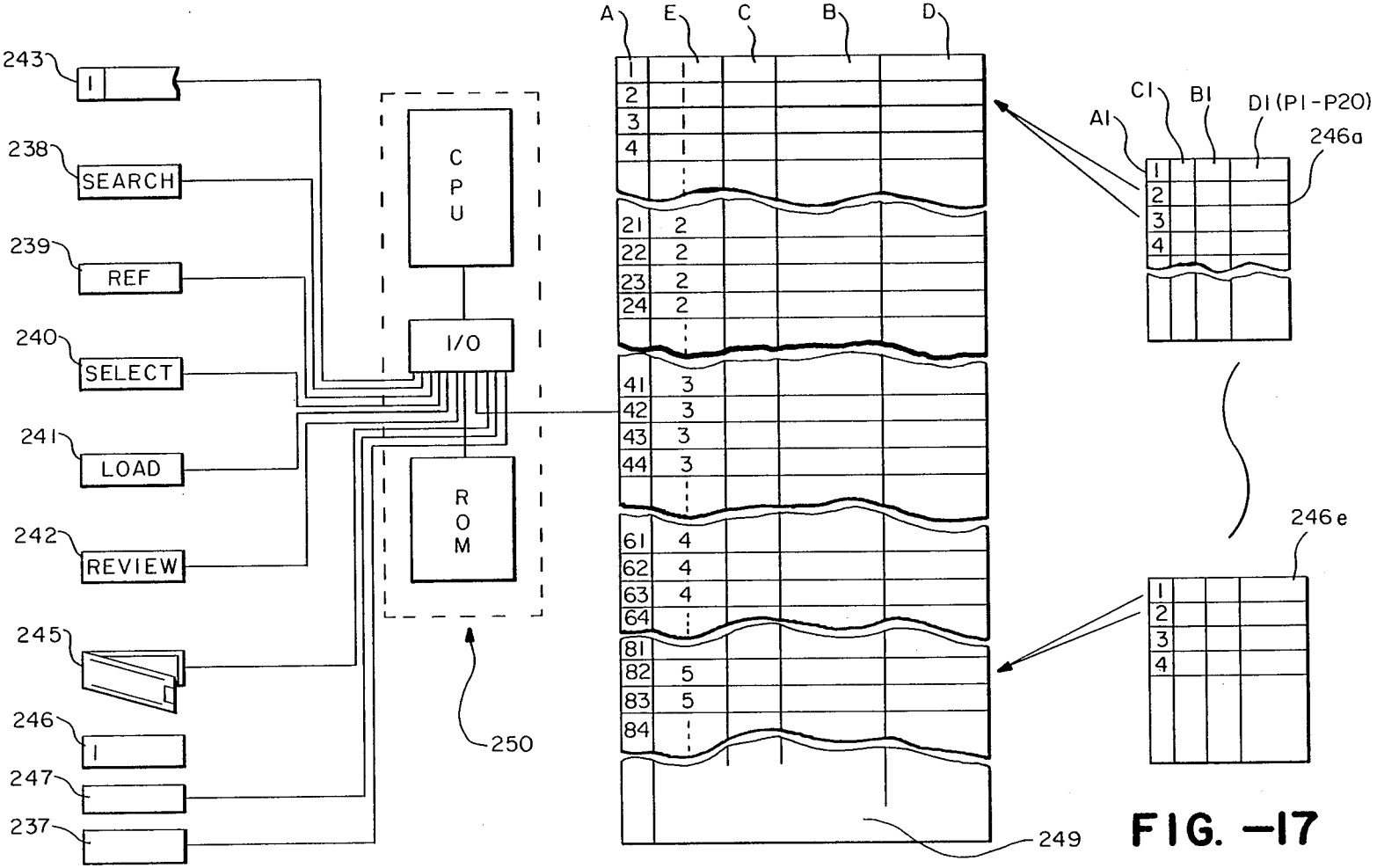
FIG. 17 is a block circuit diagram of the control unit of FIG. 16.

In FIGS. 16 and 17, numeral 237 indicates a display window for displaying output data. It typically comprises a liquid crystal display element. Numeral 238 indicates a search (SEARCH) key for causing a sequential search of data related to cooking programs (stored in Column B) corresponding to specified addresses (such as from 1 through 20 and from 21 through 40 shown in Column A) in a RAM means 249 within the control unit 4. The search key 238 also serves to transmit to a control circuit (a microcomputer) 250 inside the control unit 4 a command to have these data displayed in the display window 237 in units of four programs.

Numeral 239 indicates a reference data (REF) key. After the user specifies a menu from the menu names stored in Column C, the reference data key 239 serves to transmit to the control circuit 250 a command to output in the display window 237 reference data such as the page number in a specified cook book where relevant information may be found, the time required for cooking and the calorie value regarding the specified menu (stored in Column D). Numeral 240 indicates a select (SELECT) key. After the search key 238 is pressed and data on four programs have been displayed in the display window 237, if the user finds one of the displayed menus interesting, the select key 240 may be pressed to transmit to the control circuit 250 a command to specify this menu. Each time the select key 240 is pressed, the position of a flashing light shifts from one menu to another as will be explained more in detail below in connection with FIG. 19. Numeral 241 indicates a load (LOAD) key which has the following two functions. One is to issue a command to transfer a program (stored in Column B) specified by the aforementioned select key 240 to a free area in the control circuit 250 adapted to accept an oven controlling program. The other function is to output a command to transfer data related to a cooking program stored in a memory module 246 (to be explained below) to the RAM 249 which serves as the main storage means as will be explained more in detail below. Numeral 242 indicates a review (REVIEW) key which the user can use to review previously displayed data. Therefore, it is like the search key 238 and serves to transmit to the control circuit 250 a command to conduct a search but in the reverse order, or in the descending order of the addresses.

Numeral 243 indicates a group number key for transmitting to the control circuit 250 a command to select a group (identified by a symbol in Column E in FIG. 17) of cooking programs of interest when the search key 238 or the select key 240 is pressed for a particular operation. Numeral 244 indicates a program guidance label describing the names of menus belonging to each program group. Since each group includes twenty programs according to the embodiment illustrated in FIG. 17 but the control unit 4 is usually not large enough to display twenty menu names as illustrated in FIGS. 16 and 17, the names of only a part of the accessed programs representative of the group are actually displayed. Suppose, for example, that Group 5 (or menus with "5" in Column E of the RAM 249 with reference to FIG. 17) has been selected by the group name key 243 and further that Group 5 includes four programs using beef, three programs using pork, two programs using bacon, two programs using ham, five programs using ground beef and four programs using chicken. Although a total of twenty programs is thus accessed, it may be only the following five menus that are displayed: (1) beef steak, (2) spareribs, (3) Canadian bacon, (4) meatballs, and (5) chicken wings. Numeral 245 indicates a memory module access panel for installing and removing a memory module 246 to or from the control unit 4 and serves as a door. The memory module 246 may be an external memory element such as a RAM module, battery-backed or otherwise. Any memory element such as an IC card and an optical card of appropriate size and memory capacity which may be developed in the future can be adapted for use. Numeral 247 indicates a search counter for displaying the number of times the search key 238 has been actuated. It is automatically reset when a search of all menus in a menu group (represented by a number in Column E) is completed (actuation four times). If the user remembers the number shown at this counter 247 when the program for a favorite menu was displayed, a quick access becomes possible at the time of a subsequent search. Columns C, B and D of the RAM 249 are comparable to the columns for entering various menu data such as menu names shown in FIG. 15.

FIG. 17 additionally shows that the control circuit 250 comprises a central processing unit (CPU), an input/output circuit (I/O) and a ROM means (ROM). Numerals 246*a*–246*e* indicate that a plurality of memory modules may be used. Data stored in these modules are adapted to be loaded into specified regions of the RAM 249 presented by group numbers (shown in Column E). For example, if one of the memory modules (say, 246*a*) is set in the control unit 4 through the module access panel 245 and the load key 241 is pressed after the group number key 243 with "1", for example, is selected, the twenty sets of cooking program data P1–P20 are loaded in the ram at memory addresses 1-20.

Figure 18:
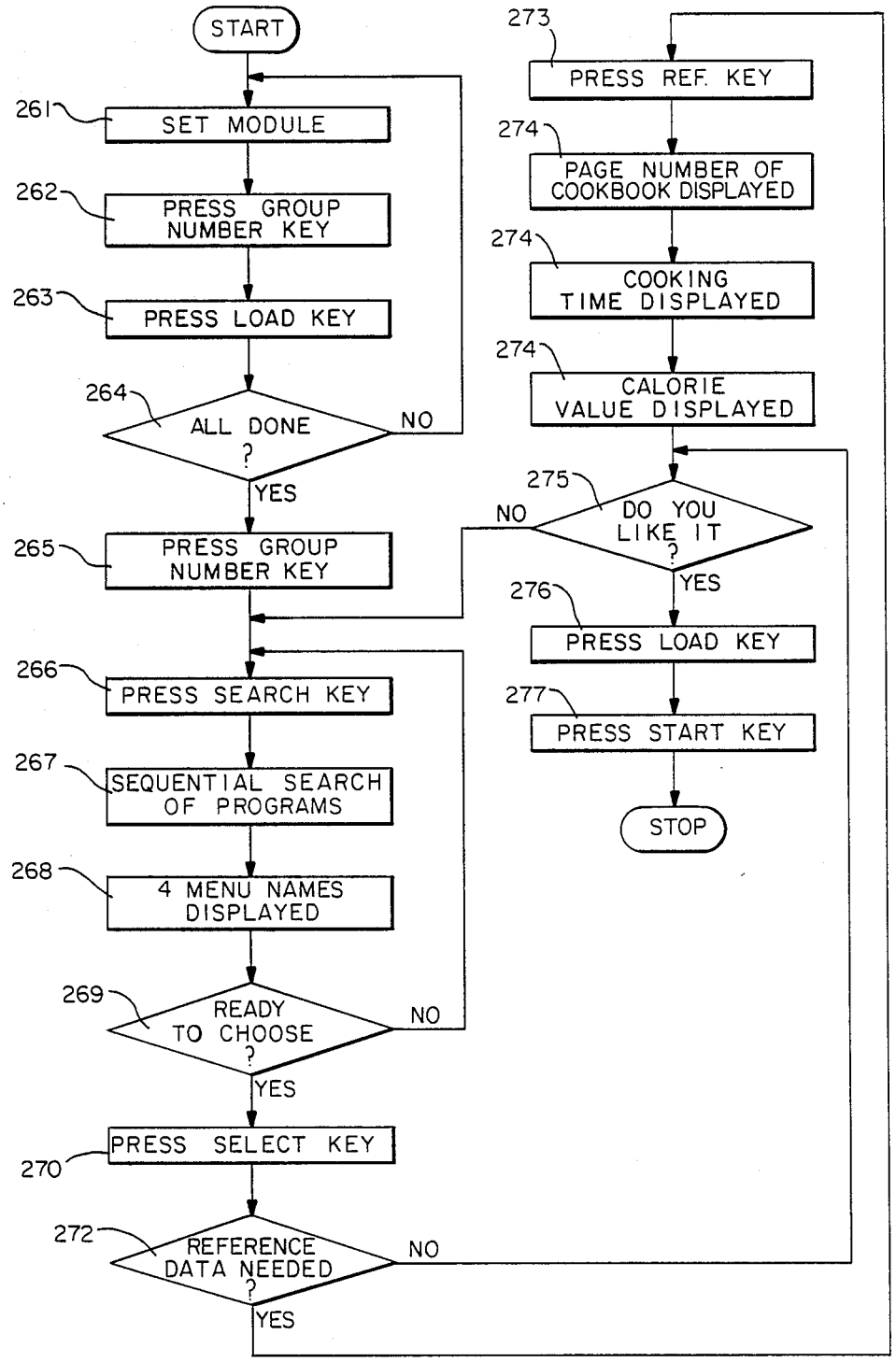
FIG. 18 is a flow chart for the operation of the control unit of FIGS. 16 and 17.

Operation of the control unit 4 of FIGS. 16 and 17 is explained next by way of FIG. 18 which shows processes both by the unit and by the user and FIG. 19 which shows the relationship between operations and displays. Reference being made first to FIG. 18, the flow chart starts with the stage of loading reference data related to cooking program menus. First, one of the memory modules 246 (such as the module 246*a*) is set in the control unit 4 by opening the module access panel 245 which forms a part of the housing thereof (Step 261). The user then selects an address group in the RAM 249 and presses a group number key 243 corresponding to the selected address group (Step 262). When the load key 241 is pressed (Step 263), the loading of the data on the memory module set in the control unit 4 is executed. The sequence described above is repeated if there are additional memory modules from which it is desired to transfer data into the RAM 249 (Step 264).

After the loading stage (Steps 261 through 264) is completed, the user is ready to have menus displayed from any of the menu groups inputted into the RAM 249. The user in this situation need not consult any instruction book because menu groups are displayed on the program guidance label 244. The user has only to check the descriptions of the guidance label 244, selects one of the menu groups and actuates a group number key 243 corresponding to the selected menu group (Step 265) and then the search key 238 (Step 266). As shown on the left-side of FIG. 19, the search key 238 may have to be pressed more than once before the user can find a menu to be selected. This is so because, as explained above, there are twenty menus included in each menu group but only four of them can be displayed at once. Each time the search key is pressed, a sequential search is performed (Step 267) and a new set of four menu names appears (Step 268). According to the example shown in FIG. 19, four names (BOHEMIAN STEAK, etc.) shown in the display 321 appear in the display window 237 when the search key 238 is pressed first and another set of four names (BEEF CONVENIENCE FOOD, etc.) shown in the display 322 appear when the search key 238 is pressed for the second time. The user can examine all twenty menu names in the group in five (=20/4) cycles of the search key operation described above, or by pressing the search key 238 five times. If the search key 238 is pressed for the sixth cycle, the display window 237 will show the same display which was made initially. If, during the course of a search, the user wants to go back and look at a previously displayed menu again, the review key 242 should be pressed any number of times until the desired menu appears again because as explained above, the review key 242 is for conducting a search in the reverse order.

Let us assume that the user, upon examining the second display 322, decided to select the program for round steak stew. Whenever a new display (such as 321 and 322) appears, however, there is a blinking light 340 appearing in front of the first display item as shown in FIG. 19. The blinking light 340 means in this situation that the menu the name of which appears adjacent to the blinking light will be considered to have been selected if the load key 241 were then pressed. Since the blinking light 340 in the second display 322 is in front of a wrong menu name, the user must press the select key 240 (Step 270) after ascertaining that the current display includes what he or she wants to select (Step 269). The position of the blinking light 340 shifts each time the select key 240 is pressed. After the select key is pressed an appropriate number of times, the display must look as indicted by numeral 323 with displayed menu names being identical to those in the previous display 322 before the select key 240 was pressed but the blinking light 340 being now in front of the menu name of the desired program (Step 271).

After the blinking light 340 has been shifted to the position of the desired menu name (Step 271), if the user wants reference data displayed regarding the menu which has been selected (YES in Step 272), the reference key 239 should be pressed (Step 273) and the desired reference data are retrieved from the RAM 249 and displayed in the display window 237 (Step 274). Numeral 324 indicates an example of display which may appear in this situation, including the page and volume numbers of a cookbook made a part of the microwave oven, the length of time required for the cooking and the calorie value. If the user, having reviewed the displayed reference data 324 or without requesting to see the reference data (NO in Step 272), decides to go along with the selected menu (YES in Step 275), the load key 241 is pressed (Step 276) first and then the starting key (not shown) to start the cooking sequence. Alternatively, the user may press the search key 238 even after the select key 240 has been pressed (NO in Step 275) and go back to Step 66 to repeat the selection process again.

In summary, the control unit 4 explained above by way of FIGS. 16 through 19 makes use of removable memory modules to input various cooking sequence programs and the program names recorded in such modules can be displayed in small units. Additional reference data are also recorded in these modules and the user, if necessary, can optionally have them displayed on the control unit.

A control unit for a heating system such as a microwave oven according to a further embodiment of the present invention is described next by way of FIG. 20 and 21. A control unit of this embodiment is similar to the one described above by way of FIGS. 16–19 and hence many of its components which are essentially identical both in appearance and regarding their functions to their counterparts in the control unit of FIGS. 16 and 17 are assigned the same numerals.

Figure 20:
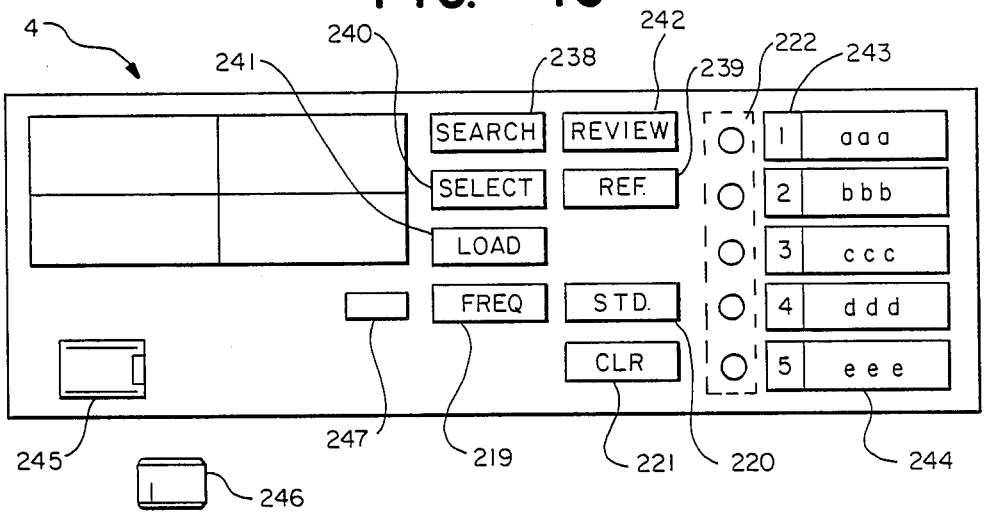
FIG. 20 is a front view of a control unit for a microwave oven according to a further embodiment of the present invention.
Figure 21:
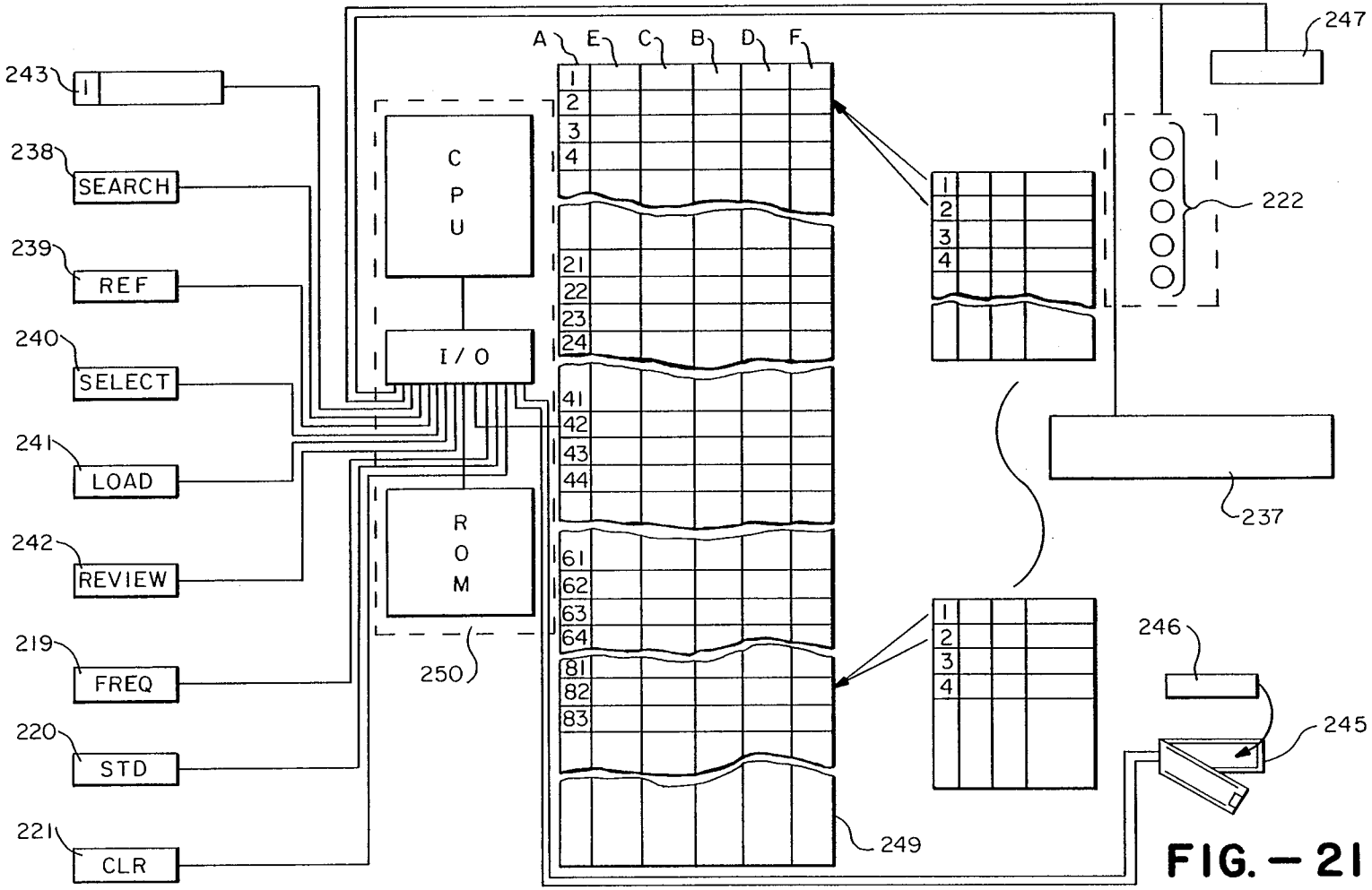
FIG. 21 is a block circuit diagram of the control unit of FIG. 20.

FIG. 20 which is a front view and FIG. 21 which is a block circuit diagram show that the control unit according to this embodiment is nearly identical to the one described in FIGS. 16 and 17 except there are provided three additional keys which are a frequency checking (FREQ) key 219, a standard frequency value setting (STD) key 220, and a standard frequency value clearing (CLR) key 221 and warning lamps 222 such as light emitting diodes (LED).

The FREQ key 219 is for operating when it is desired to check how the individual cooking programs are being used. If the FREQ key 219 is pressed and then the aforementioned SEARCH key 238 or SELECT key 240 is used to specify a cooking program, the number of times this specified program has been used (or the frequency) is examined. If this number is "0", the warning lamp 222 which corresponds to the particular menu group to which the specified cooking program belongs is lit to warn the user. In other words, the FREQ key 219, together with the warning lamps 222, serves to show the existence of programs remaining unused.

The STD key 220 is for transmitting to the control circuit (microcomputer) 250 a command to set for each menu group a standard value for the ratio between the number of programs which have been used at least once and the total number of programs belonging to that menu group. A menu group for which this ratio is smaller than the standard value set by this key will be considered unused or rarely used. It is preferable to use a step key for this purpose such that the setting can be effected in units of 10%.

The CLR key 221 is for transmitting to the control circuit (microcomputer) 250 a command to erase standard values inputted by the STD key 220 and frequency values (to be explained below) recorded in the RAM 249. The CLR key 221 is so structured that a standard value is erased if it is pressed once and that a frequency value is erased if it is pressed twice.

The light emitting diodes 222 have the following two functions. One is, as briefly described above, to monitor for each menu group the ratio between the number of programs which have been used and the total number of programs. If this ratio reaches the standard value set by the STD key 220, the corresponding light emitting diode 222 is lit and remains lit until the cancellation of the frequency value is executed by the aforementioned operation on the CLR key 221. The other function is to check the use records of the individual cooking programs. After the FREQ key 219 is pressed to select the use frequency checking mode of operation, if the SEARCH key 238 and the SELECT key 240 are used, as explained above in connection with the control unit of FIGS. 16–19, to specify a program, the corresponding diode 222 is lit only if the specified program has not been used, or if its frequency value is "0".

With the structure described in FIGS. 20 and 21, the control unit according to this embodiment of the present invention can perform the following functions in addition to those described in connection with the control unit of FIGS. 16–19. Firstly, the user may define a certain monitoring period such as one month. After such a monitoring period, if there is a menu group for which the warning lamp 222 is not lit, the display window 237 can be caused to display a message recommending the user to try the cooking programs belonging to the corresponding unused or not-so-frequently-used menu group. Secondly, when there is such a rarely used menu group, the control unit may be so programmed that the user can find out which of the programs belonging to that group have actually not been used. This may be accomplished, for example, by flashing the lamp 222 when the corresponding program is displayed in the display window 237.

Figure 19:
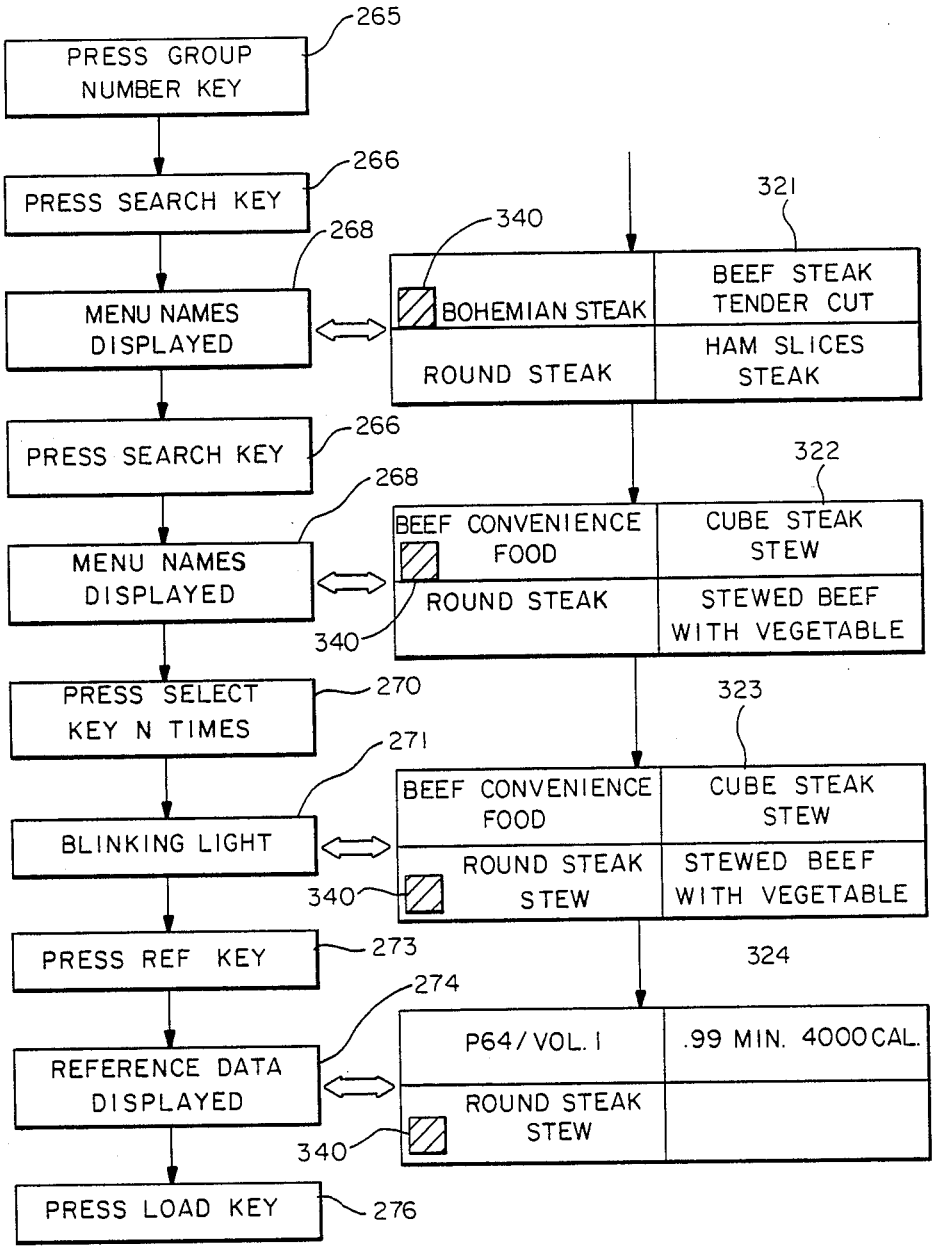
FIG. 19 is a diagram showing the relationship between the key operation and display of the control unit of FIGS. 16 and 17.
Figure 22:
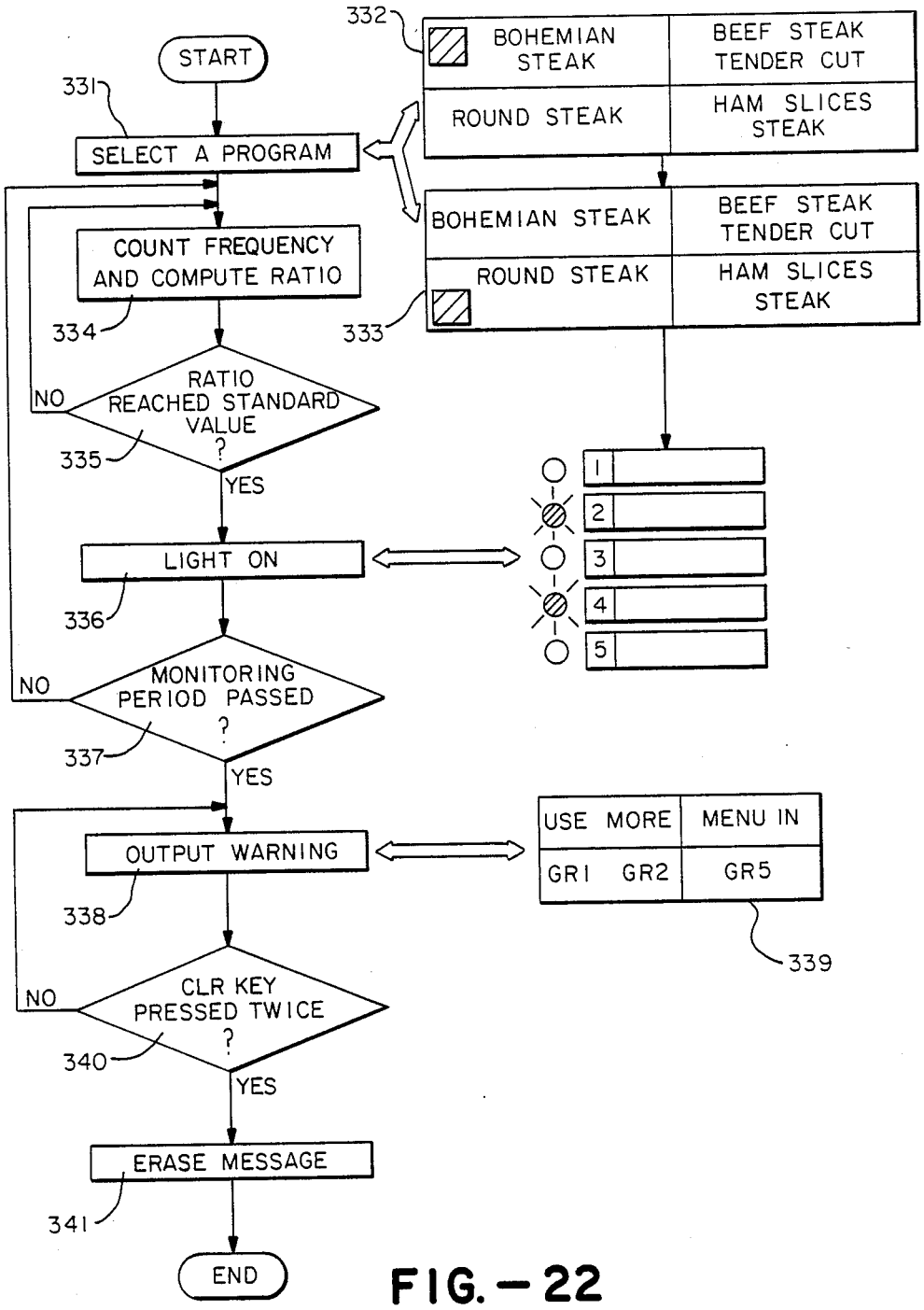
FIG. 22 is a flow chart showing a mode of operation of the control unit of FIGS. 20 and 21.
Figure 23:
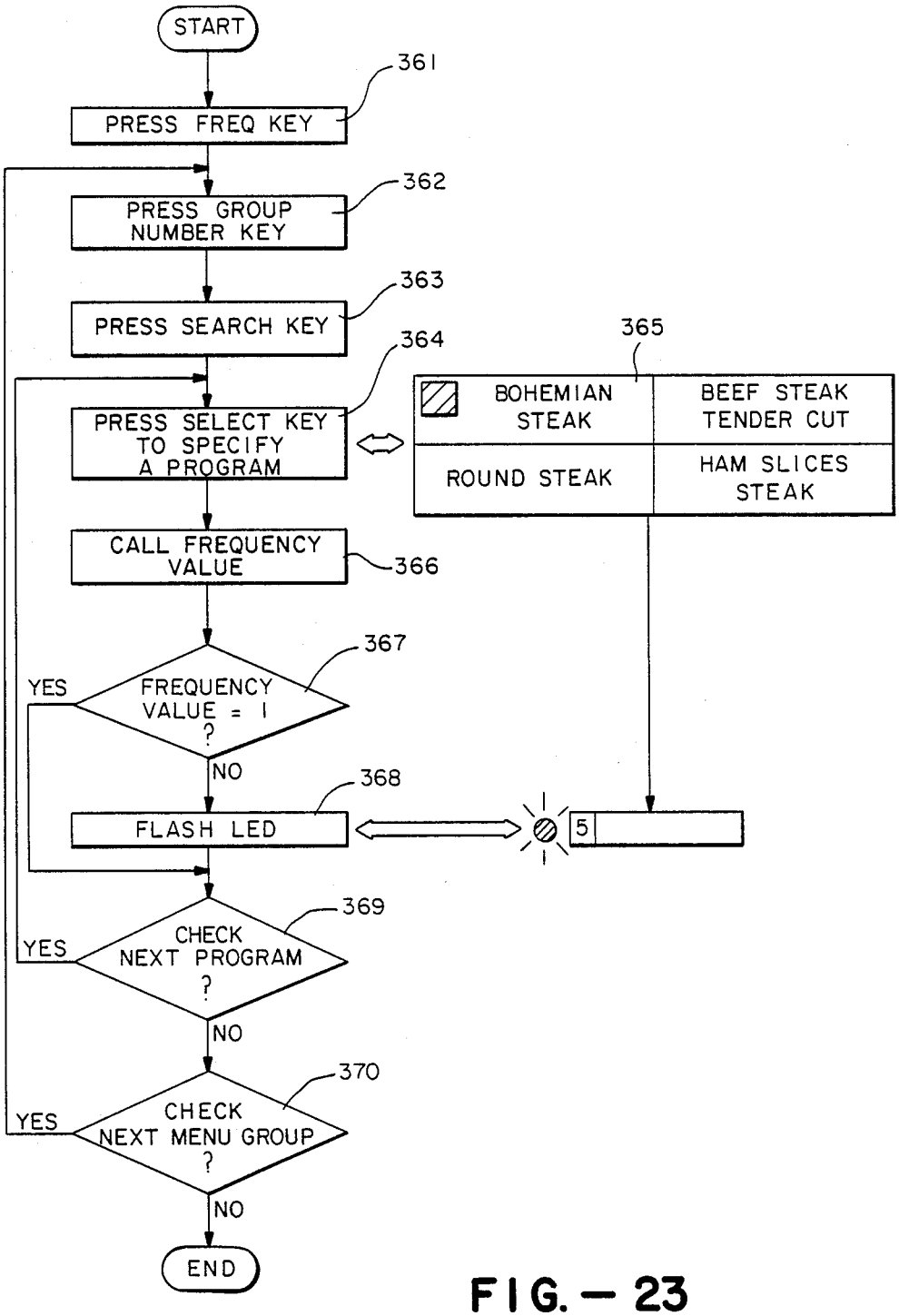
FIG. 23 is a flow chart showing another mode of operation of the control unit of FIGS. 20 and 21.

FIGS. 22 and 23 are comparable to FIG. 19 and show how these functions of the control unit of FIGS. 20 and 21 can be performed and the kind of displays that may appear in the display window 237. Reference being made firstly to FIG. 22, there is shown a mode of operation wherein keys are pressed in the order of a group number key 243, the SEARCH key 238, the SELECT key 240 and the LOAD key 241. Let us assume that the user has proceeded as explained in connection with FIG. 19 by pressing a group number key 243 and the SEARCH key 238 to cause a display BOHEMIAN STEAK, etc. 332 and, having decided to prepare a round steak dinner, by pressing the SELECT key 240 to shift the position of the blinking light as shown in the second display 333 (Step 331). Thereafter, the novel feature of this embodiment begins to operate and the number of times this selected program (round steak in this example) has been used is counted and the ratio between the number of programs in this menu group (selected above by pressing a group number key 243) which have been used at least once and the total number of programs in this menu group is computed on the basis of the updated frequency value (Step 334). A standard frequency value is assumed to have been set by operating the STD key 220 as explained above and a comparison is made between the calculated ratio and this standard value previously inputted (Step 335). If the calculated ratio has not reached the standard value (NO in Step 335), the warning lamp 222 pointing the selected menu group remains extinguished. If the ratio is found to have reached the standard value (YES in Step 335), on the other hand, the warning lamp 222 pointing the selected menu group is turned on (Step 336). FIG. 22 shows, as an example, a situation where the calculated ratio has reached the standard value in Groups 2 and 4 and this display continues until a monitoring period (also assumed to have been initially set) has passed (YES in Step 337) and a warning message 339 appears in the display window 237 (Step 338). This message 339 remains displayed until the CLR key 221 is operated twice (YES in Step 340) and when it is erased (Step 341).

Reference being made secondly to FIG. 23, there is shown another mode of operation wherein the FREQ key 219 is pressed (Step 361) for the purpose of examining whether an individual program or programs have been used before. Thereafter, a group number key 243, the SEARCH key 238 and the SELECT key 240 are pressed as in the case of the previously explained mode of operation (Steps 362, 363 and 364). For the sake of convenience, let us assume that the user now wishes to check whether the program for Bohemian steak has been used before. With the display at this moment being as indicated by numeral 365 with a blinking light pointing to "BOHEMIAN STEAK", the use status of this program is retrieved from the memory (Step 366) and if the frequency number (or the number of times this program has been used) is not 1 or greater (NO in Step 367), the warning lamp 222 pointing to the menu group to which this program belongs is flashed as shown on the right-hand side of Step 368. Thereafter, the user presses the SELECT key 240 again if it is desired to check another program belonging to the same menu group (YES in Step 369) and another group number key 243 if it is desired to check a program in another menu group (YES in Step 370).

Figure 24:
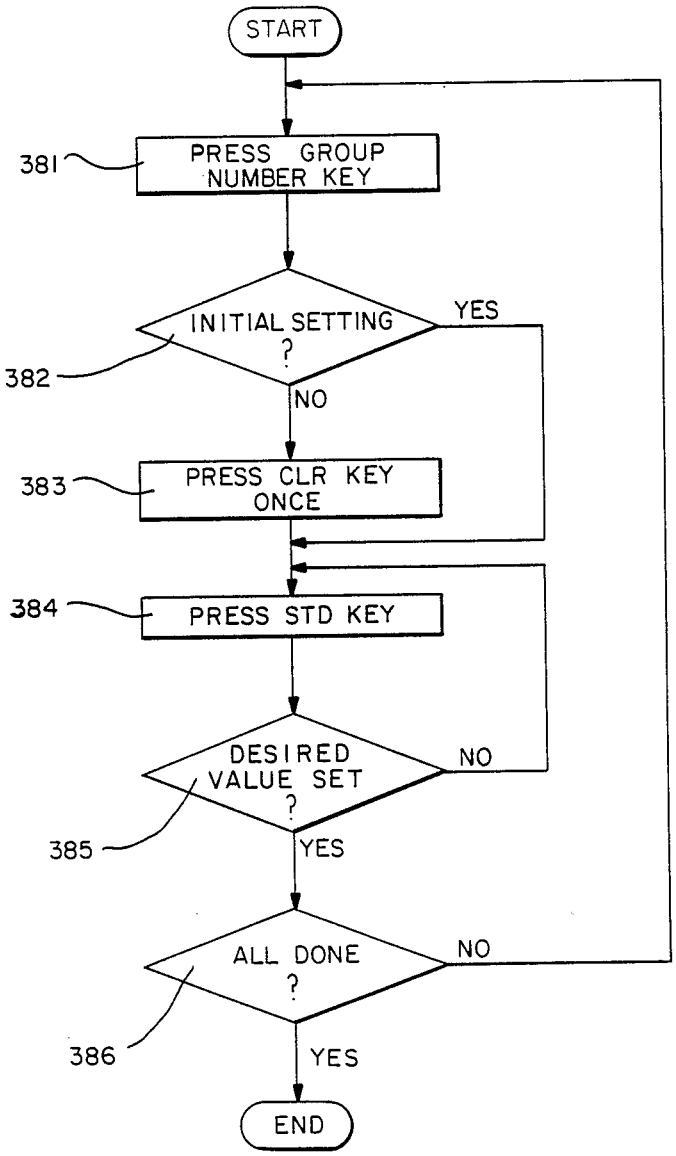
FIG. 24 is a flow chart showing the operation for setting a standard frequency value.

The routine to be followed for selecting the aforementioned standard frequency value and setting it in the control circuit 250 is explained next by way of FIG. 24. A group number key 243 is pressed first (Step 381) to select a menu program for which the standard frequency value is being set. If this setting is not the first time and there is a previously set value (NO in Step 382), the CLR key 221 must be pressed next to erase it to make a way for entering a new value (Step 383). Thereafter, the STD key 220 is pressed (Step 384) as explained above until the desired value is set (Step 385). If the user wishes then to set the standard frequency value for another menu group (NO in Step 386), the new menu group must be specified by returning to Step 381.

The foregoing description of the invention has been presented for purposes of illustration and description. It is not intended to be exhaustive or to limit the invention to the precise forms disclosed, and obviously many modifications and variations are possible in light of the above teaching. For example, the external views shown in FIGS. 2, 10, 16 and 20 are not intended to represent preferred arrangements or dimensional relationships among the components. The number of keys 52 in FIG. 2, the number of switches 12 in FIG. 10, and the number of group numbers 243 in FIGS. 16 and 20 which can be displayed at one time do not limit the scope of the invention. Arrangements inside the RAM 249 can be modified in whichever way convenient for the situation and/or the microcomputer 250 employed. The external memory means 246 may be a ROM, a battery-backed RAM, an IC card or an optical card, either presently available or to be developed in the future, and may be functionally connectable to the main (RAM) memory means 249 in any practicable manner. The heating system which the control unit of this invention is intended to serve need not look exactly as shown in FIG. 8. All sorts of imaginable information can be made a part of reference data that may be stored and displayed. In summary, such modifications and variations that may be apparent to a person skilled in the art are included within the scope of this invention.

What is claimed is:

1. A control unit for a heating system comprising a memory means having memory areas for storing data and cooking programs to be inputted thereto and outputted therefrom, display means including a current program display window and a plurality of individual program display windows, external memory means with memory modules for storing data to be loaded in said memory means, control means serving to cause data stored in said memory means to be displayed by said display means, program indicating means individually associated with said individual program display windows for specifying a program displayed in one of said individual program display windows, menu entry means for causing said control means to store selected one or more of programs stored on said external memory, means to be stored at specified one or more of said memory areas of said memory means, menu call means for causing data associated with a program stored in said memory means and specified by said program indicating means to be displayed in said current program display window, and starting means for causing said control means to start executing a program stored in said memory means and specified by said program indicating means and to display in said current program display window data associated with said program.

2. The control unit of claim 1 wherein said memory modules are selected from the group consisting of ROM modules, battery-backed RAM modules, IC cards and optical cards.

3. The control unit of claim 1 wherein said control means serves to cause data stored in said memory means to be partitioned into units and displayed by said display means in said units.

4. The control unit of claim 1 wherein said memory modules are individually removably attachable to said control unit.

5. The control unit of claim 1 wherein said control means further serves to cause said memory means to store count numbers of times said program indicating means have used specified programs, said control unit further comprising count calling means for causing said control means to display in said current program display window a specified one of said count numbers stored in said memory means.

6. The control unit of claim 1 wherein said control means is programmed to display an input requesting symbol in said display means to request one of said program indicating means to be selectively operated.

7. The control unit of claim 1 wherein said control means also serves to set a standard value to compare with the number of times a program recorded in said memory means has been used.

8. The control unit of claim 1 wherein said control means also serves to output a warning when one of the programs recorded in said memory means is selected if the number of times said selected program has been used is less than a standard value.

9. The control unit of claim 1 wherein said control means also serves to output after a predetermined monitoring period a message identifying those of programs recorded in said memory means which have been relatively unused.

10. The control unit of claim 6 wherein said control means also serves to output after a predetermined monitoring period a message if any of said programs has been unused.

11. A control unit for a heating system adapted to removably attach thereto a menu selection aid unit which comprises a first memory for storing cooking programs and data individually associated to said cooking programs for different portions, a display means, questioning means for causing questions to be sequentially displayed on said display means for determining a type of cooking programs to be selected, portion setting means for inputting a desired number of portions in response to a portion requesting question displayed on said display means, a plurality of switch means for selectably inputting responses sequentially in response to questions sequentially displayed on said display means and thereby causing one or more recommended menus to be retrieved from said first memory means and displayed on said display means, said recommended menus being selected according to said desired number of portions inputted through said portion setting means and said responses inputted through said switch means, modifying means for modifying one or more of said responses inputted through said switch means, selecting means for selecting one of said recommended menus displayed on said display means, reviewing means for causing data inclusive of ingredients associated with said selected menu selected by said selecting means to be displayed on said display means, a counter means for counting the numbers of times said cooking programs have been used, a second memory means for storing said numbers and cooking sequence data, and a data transferring means for selectively causing said cooking sequence data from said aid unit to said control unit.

12. The control unit of claim 11 wherein each of said switch means comprises a linearly slidable operating piece and a plurality of discrete positions for said piece at which one of said displayed data can be selected.

13. The control unit of claim 11 wherein said questions include what should be the main ingredient, whether the time required to cook may be longer than a predetermined time length and what method of heating is intended.

14. A control unit for a heating system comprising a control means, memory means for storing data, said memory means having groups of memory areas each with an address, display means for displaying data, module access means for connecting said control unit with an external memory module means such that data related to cooking programs and stored on said memory module can be transferred into said memory means, group specifying means for selectively specifying one of said groups, loading means for causing said central processing means to transfer programs from an external memory module connected to said control means through said module access means into said memory means and to store said transferred programs individually and sequentially according to said addresses in those of said memory areas of the group specified by said group specifying means, labels each associated with one of said group specifying means and describing said associated one of said groups, searching means for causing said control means to sequentially display in said display means according to said addresses a set of a plural n-number of those of said cooking programs stored in those of said memory areas of a group specified by said group specifying means, and selecting means for selecting one of said plural n-number of cooking programs displayed in said display means, said loading means further serving to transfer data related to the cooking program selected by said selecting means to a free space inside said memory means and said control means further serving in response to a start signal to execute the cooking program selected by said selecting means.

15. The control unit of claim 11 further comprising referencing means for causing said control means to display in said display means reference data associated with the cooking program selected by said selecting means.

16. The control unit of claim 11 further comprising a counter which displays the number of times said searching means has been operated.

17. The control unit of claim 11 further comprising warning means for displaying a warning signal corresponding individually to said groups, frequency checking means for causing said control means to check the frequency number of times use has been made of a cooking program specified by said selecting means and to cause a warning signal to be displayed on one of said warning means corresponding to the group of said specified cooking program, depending on said checked frequency number of said specified program, standard frequency setting means for transmitting to said control means a command to set for each of said groups a standard frequency value for the ratio between the number of programs used at least once and the total number of programs belonging to the group and to store said standard frequency value in said memory means, and cleaning means for causing said standard frequency value stored in said memory means to be erased.

18. The control unit of claim 17 wherein said control means causes said warning signal to be displayed by said display means corresponding to a group, depending on whether said ratio for said group is larger or smaller than said standard frequency value.

* * * * *